United States Patent [19]

Hirayama

[11] 4,381,736

[45] May 3, 1983

[54] ENGINE COOLING SYSTEM PROVIDING MIXED OR UNMIXED HEAD AND BLOCK COOLING

[75] Inventor: Tsutomu Hirayama, Susono, Japan

[73] Assignee: Toyota Jidosha Kogyo Kabushiki Kaisha, Toyota, Japan

[21] Appl. No.: 255,056

[22] Filed: Apr. 17, 1981

[30] Foreign Application Priority Data

Apr. 18, 1980 [JP] Japan ..... 55-52025

[51] Int. Cl.[3] ..... F01P 7/16

[52] U.S. Cl. ..... 123/41.1; 123/41.29; 123/41.44; 123/41.82 R

[58] Field of Search ..... 123/41.02, 41.08, 41.09, 123/41.1, 41.29, 41.44, 41.72, 41.74, 41.81, 41.82 R

[56] References Cited

U.S. PATENT DOCUMENTS

| | | | |
|---|---|---|---|
| 1,985,240 | 12/1934 | Brubaker | 123/41.44 X |
| 3,444,845 | 5/1969 | Scheiterlein | 123/41.82 |
| 3,757,747 | 9/1973 | Hartmann | 123/41.29 |
| 4,082,068 | 4/1978 | Hale | 123/41.02 |
| 4,109,617 | 8/1978 | Ernest | 123/41.82 R |
| 4,212,270 | 7/1980 | Nakanishi et al. | 123/41.29 |
| 4,249,491 | 2/1981 | Stein | 123/196 AB |
| 4,319,547 | 3/1982 | Bierling | 123/41.29 |

*Primary Examiner*—William A. Cuchlinski, Jr.
*Attorney, Agent, or Firm*—Stevens, Davis, Miller & Mosher

[57] ABSTRACT

An internal combustion engine includes a cylinder head and a cylinder block, and is provided with a radiator. Cooling jackets are formed in the head and in the block, and separate pumps drive cooling fluid through these jackets. A sensor senses the temperature of the cooling fluid passing out from the block cooling jacket, and a controller receives a signal from this sensor. A block recirculation conduit system of high flow resistance leads from the block cooling jacket outlet to its inlet, bypassing the radiator. A main recirculation conduit system communicates at its upstream end to the outlets of both the cooling jackets, and at its downstream portion to the radiator. A radiator output conduit system leads from the radiator to the inlets of both the cooling jacket. A first control valve, controlled by the controller, controls flow through the radiator. A radiator bypass conduit system of high flow resistance leads from a downstream part of the main recirculation conduit system to the inlets of both cooling jackets, and operation of the first control valve does not cut off flow through this bypass conduit system. A second control valve controls flow from the radiator output conduit system and the radiator bypass conduit system to the block cooling jacket inlet, and is controlled by the controller.

60 Claims, 5 Drawing Figures

ENGINE COOLING SYSTEM PROVIDING MIXED OR UNMIXED HEAD AND BLOCK COOLING

BACKGROUND OF THE INVENTION

The present invention relates to an internal combustion engine cooling system, and, more particularly, relates to an internal combustion engine cooling system which provides either combined cooling for a cylinder head and a cylinder block of the engine, or either partly or totally separated cooling for the cylinder head and the cylinder block, according to operational conditions.

Various considerations arise with regard to the cooling of internal combustion engines which are cooled by the circulation of cooling fluid in passages or jackets formed in the cylinder head and the cylinder block thereof. Some of these considerations relate to the cooling of the cylinder head, and others to the cooling of the cylinder block, and accordingly the old or conventional way of cooling an internal combustion engine, in which the cooling fluid for the cylinder head was always completely mixed with that for the cylinder block, thus ensuring that the cylinder head and the cylinder block were always at substantially the same temperature, has become inadequate.

In more detail, it is important to maximize the thermal efficiency of an internal combustion engine, and in order to do this it is effective to increase the compression ratio or the engine. However, increase of the compression ratio of the engine is limited by the occurrence of so called knocking or pinking, i.e. of detonation caused by compression ignition of the air-fuel mixture within the combustion chambers of the engine. The occurrence of knocking is generally reduced by keeping the cylinder head as cool as possible, and accordingly when the internal combustion engine is being operated, especially in operational conditions in which the occurrence of knocking is a high possibility, such as high rotational speed high engine load operational conditions, it is very important to cool the cylinder head down to as low a temperature as possible.

On the other hand, it is not very advantageous to cool down the cylinder block of the engine to a very low temperature, because in that case the temperature of the lubricating oil contained within the cylinder block, which is strongly influenced by the temperature of the cylinder block, becomes rather low, thus increasing the viscosity of this lubricating oil and causing unacceptably high mechanical energy losses in the engine. Further, because the viscosity of the lubricating oil within the cylinder block when this oil is still cold, i.e. before it has attained operating temperature, is higher than when it has attained operating temperature, therefore of course while this lubricating oil is still cold it causes substantially increased use of fuel by the internal combustion engine, which is very wasteful. Further, if the temperature of the walls of the cylinders of the engine, i.e. the temperature of the bores thereof, becomes low, then the amount of uncombusted hydrocarbons in the exhaust gases emitted by the engine rises, which can cause a serious problem in view of the standards for control of pollution by automobiles, which are becoming more and more severe nowadays.

Another problem that occurs if the temperature of the cylinder block gets low is that wear on the various moving parts of the internal combustion engine, especially bore wear, rises dramatically. In fact, a large proportion of the wear on the bores of an internal combustion engine occurs when the engine is in the non fully warmed up condition, both because the lubricating qualities of the lubricating oil in the engine are not good at low temperatures, and also because the state of mechanical fit to which the parts of the engine are "worn in" or "run in" is appropriate to their physical dimensions when at proper engine operating temperature, and accordingly in the cold condition these parts do not mate together very well. In fact, in view of this matter, it has in the past been an important design goal for internal combustion engines for the moving parts thereof to be warmed up as soon as practicable, or at any rate to be brought to an intermediate temperature higher than a very cold non operating temperature as soon as practicable.

Thus, according to these considerations, it is important to warm up the cylinder block as quickly as possible, when the engine is started from the cold condition, and to keep the cylinder block at quite a high operating temperature thereafter. A difficulty arises in this regard, because during the operation of an internal combustion engine most of the heat which is being generated in the combustion chambers thereof by combustion of air-fuel mixture is in fact communicated not to the cylinder block of the engine, but to the cylinder head thereof. Therefore, transfer of heat from the cylinder head to the cylinder block is very important, especially during the warming up process of the engine. Of course, such heat transfer can take place by the process of heat conduction, since the cylinder head is clamped to the cylinder block, typically however with the interposition of a head gasket which may have a rather low heat conductivity. However, it is desirable to convey heat from the cylinder head to the cylinder block, during engine warmup, more quickly than can be accomplished by this process, and the conventional above described mixing of the cooling fluid within the cylinder head with the cooling fluid in the cylinder block, during engine warmup, is effective for achieving this.

In the prior art, it has been proposed to provide completely independent systems for cooling the cylinder head and for cooling the cylinder block, in order to fulfil the first above described objective of cooling the cylinder head to a low temperature in order to avoid knocking, while keeping the cylinder block warmer, and each of these systems has been equipped with its own fluid pump, conduits, radiator, etc. However, this system does not provide for the above described transfer of heat from the cylinder head to the cylinder block via the cooling fluid, and, since the cylinder block has a considerably large heat capacity, this means that the cylinder block does not warm up quickly from the cold condition, with the ill effects detailed above. Also, the provision of two independent cooling systems increases weight to an unacceptably high extent, and increases manufacturing cost. Further, since in the above described system two independent radiators are used, and the flow amount through each of them is regulated, it is very difficult to use total radiator cooling capacity fully.

Further, there is another effect which is advantageous, and which, in certain circumstances, it is very important to obtain, with regard to the warming up of an internal combustion engine. That is to say, when an internal combustion engine is being operated from a standing or rather cold condition, the fuel in the air-fuel mixture which is being sucked into the combustion chambers of the engine often is not sufficiently vaporized, and accordingly it may well occur that the amount of fuel which is being inhaled into the various cylinders of the internal combustion engine becomes unequal, which may cause irregular and stumbling combustion, which will cause unequal operation of the various cylinders, and a lower level of engine operational performance when the engine is in the cold operational condition, than is available when the engine has been fully warmed up. This, of course, can waste a good deal of fuel, and also can lead to problems concerned with drivability of the internal combustion engine, possibly even involving safety.

Generally, in the prior art, in order to preserve drivability of the vehicle incorporating the internal combustion engine, when said internal combustion engine is in the cold operating condition, it has been practiced to increase the quantity of fuel being provided into the air-fuel mixture being supplied to the combustion chambers of the internal combustion engine, in other words, to richen this air-fuel mixture or to decrease the air/fuel ratio thereof, by the employment of a choke means, in the case of an internal combustion engine equipped with a carburetor, or, in the case of an internal combustion engine equipped with a fuel injection system, to increase the amount of fuel provided in each injection of fuel into the combustion chambers of the engine. If this system of increasing the amount of fuel in the air-fuel mixture provided during cold operation of the internal combustion engine is practiced, then it is possible to escape from the above outlined difficulty with regard to poor performance of the internal combustion engine during cold operating conditions, but the amount of fuel used during warming up of the engine is significantly increased, which is wasteful, and also problems may well arise with regard to the amount of uncombusted hydrocarbons such as HC and CO which are emitted in the exhaust gases of the internal combustion engine at this time.

Another method that has been practiced in the prior art to improve the vaporization of the fuel in the air-fuel mixture which is being supplied to the combustion chambers of the internal combustion engine, in the case of an internal combustion engine which is provided with a carburetor, has been to provide the intake manifold of the internal combustion engine with a riser member which has been heated, either by heat obtained from the exhaust gases of the internal combustion engine, or from heat obtained from an electrical heating system. However, a difficulty arises, in that although on passing this riser member the fuel contained in the air-fuel mixture being sucked into the combustion chambers of the internal combustion engine may well be effectively vaporized, there is a danger of recondensation of part of this fuel, when the air-fuel mixture is actually being sucked into the combustion chambers of the internal combustion engine past the valve ports thereof, when said valve ports are still cold.

Further, in an internal combustion engine provided with a fuel injection system, because it is a desirable feature of conventional construction for the injection of fuel to be performed quite close to the inlet valves of the internal combustion engine, therefore from a point of view of construction it is rather difficult to heat this part of the intake system of the internal combustion engine by the use of heat obtained from the exhaust gases, or from an electrical heater. Therefore, in view of the above described difficulty, especially in cold external operating conditions of the internal combustion engine such as cold climatic conditions, it becomes more important to heat up the material of the cylinder head which surrounds the inlet ports of the combustion chambers thereof, i.e. to heat up the cooling fluid contained within the cylinder head, as quickly as possible, by the heat generated in the combustion chambers thereof. This heating up should proceed until at least the material of the cylinder head which surrounds the inlet ports thereof attains a temperature sufficient to provide a good so called intake mixture vaporization effect. A sufficient such temperature may be around 80° C.

However, it has been difficult, in the forms of art explained above wherein during heating up of the internal combustion engine the cooling fluid within the cylinder head and the cooling fluid within the cylinder block have been mixed, for the cylinder head of the internal combustion engine to be warmed up sufficiently quickly to provide this intake mixture warming up effect, because of the high heat capacity of the cooling fluid contained within the cylinder block, and of the cylinder block. Of course, it will be understood that the real difficulty with regard to the intake mixture warming up effect only occurs during warming up of the internal combustion engine from the very cold condition, or the so called stone cold condition. However, even when the engine is started from a not very cold state, it is of course desirable that the cylinder head should be warmed up as soon as possible in order to effect good vaporization of the fuel in the fuel-air mixture. Once the internal combustion engine has been operating for a few minutes, no further practical considerations exist with regard to this intake mixture warming up effect, since in operation of the internal combustion engine when it is at all warm the parts of the cylinder head around the inlet ports thereof are very warm.

SUMMARY OF THE INVENTION

Accordingly, it is an object of the present invention to provide a cooling system, and a method for operating said cooling system, which improve upon the anti knock characteristic of an internal combustion engine.

It is a further object of the present invention to provide a cooling system for an internal combustion engine, and a method of operating the cooling system, which keep the cylinder head cool, so as to reduce the possibility of the occurrence of knocking in the combustion chambers of the internal combustion engine.

It is a further object of the present invention to provide a cooling system for an internal combustion engine, and a method of operating the cooling system, which, when the internal combustion engine has reached a steady operational condition, keep the cylinder head thereof cooler than the cylinder block.

It is a further object of the present invention to provide a cooling system for an internal combustion engine, and a method of operating the cooling system, which warm up the cylinder block of the internal combustion engine as quickly as possible.

It is a further object of the present invention to provide a cooling system for an internal combustion engine, and a method of operating the cooling system, which keep the cylinder block of the internal combustion engine considerably warm during operation thereof, thus keeping emission of unburnt hydrocarbons in the exhaust gases of the internal combustion engine low.

It is a further object of the present invention to provide a cooling system for an internal combustion engine, and a method of operating the cooling system, which warm up the lubricating oil in the cylinder block of the engine quickly from the engine cold condition, and which thereafter keep this lubricating oil hot.

It is a further object of the present invention to provide a cooling system for an internal combustion engine, and a method of operating the cooling system, which, by warming up the cylinder block of the internal combustion engine quickly from the cold condition, and by keeping it warm during operation of the internal combustion engine, minimize frictional energy losses in the engine.

It is a yet further object of the present invention to provide a cooling system for an internal combustion engine, and a method of operating the cooling system, which minimize engine warming up time.

It is a yet further object of the present invention to provide a cooling system for an internal combustion engine, and a method of operating the cooling system, which minimize engine wear during warmup of the internal combustion engine.

It is a yet further object of the present invention to provide a cooling system for an internal combustion engine, and a method of operating the cooling system, which minimize fuel utilization during warmup of the internal combustion engine.

It is a yet further object of the present invention to provide a cooling system for an internal combustion engine which is of low weight.

It is a yet further object of the present invention to provide a cooling system for an internal combustion engine, and a method of operating the cooling system, which allow for maximum radiator cooling capacity utilization during operation of the internal combustion engine.

It is a yet further object of the present invention to provide a cooling system for an internal combustion engine, and a method of operating the cooling system, which avoid any possibility of thermal shock to the cylinder head of the internal combustion engine.

It is a yet further object of the present invention to provide a cooling system for an internal combustion engine, and a method of operating the cooling system, which provide a good intake gas vaporization effect.

It is a yet further object of the present invention to provide a cooling system for an internal combustion engine, and a method of operating the cooling system, which reduce the necessity for the employment of a choke system for the internal combustion engine, during warming up operation.

It is a yet further object of the present invention to provide a cooling system for an internal combustion engine, and a method of operating the cooling system, which ensure that the operation of a heater used in conjunction with the internal combustion engine is efficacious and steady.

Accordingly to the present invention, these and other objects are accomplished by, for an internal combustion engine comprising: (a) a cylinder head formed with a head cooling jacket for cooling said cylinder head, said head cooling jacket being formed with a cylinder head inlet and a cylinder head outlet; (b) a cylinder block formed with a block cooling jacket for cooling said cylinder block, said block cooling jacket being formed with a cylinder block inlet and a cylinder block outlet; and (c) a radiator formed with an inlet and an outlet; a cooling system, comprising: (d) a first pump for impelling cooling fluid through said head cooling jacket from said cylinder head inlet towards said cylinder head outlet; (e) a second pump for impelling cooling fluid through said block cooling jacket from said cylinder block inlet towards said cylinder block outlet; (f) a block output fluid temperature sensor for sensing the temperature of the cooling fluid which passes out through said cylinder block outlet of said block cooling jacket, and for generating a sensed block output temperature signal representative of said temperature; (g) a block recirculation conduit system of relatively high flow resistance, leading from said cylinder block outlet of said block cooling jacket so as to supply flow of cooling fluid to said cylinder block inlet thereof; (h) a main recirculation conduit system, an upstream part of which is communicated both to said cylinder head outlet of said head cooling jacket and also to said cylinder block outlet of said block cooling jacket, and a downstream part of which is communicated to said inlet of said radiator; (i) a radiator output conduit system, leading from said outlet of said radiator both to said cylinder head inlet of said head cooling jacket and also to said cylinder block inlet of said block cooling jacket; (j) a first control valve for controlling flow of cooling fluid through said radiator according to a radiator flow regulation signal; (k) a radiator bypass conduit system, of relatively high flow resistance, which leads from a downstream part of said main recirculation conduit system both to said cylinder head inlet of said head cooling jacket and also to said cylinder block inlet of said block cooling jacket, operation of said first control valve so as to cut off said flow of cooling fluid through said radiator not cutting off flow of cooling fluid through said radiator bypass conduit system; (l) a second control valve for controlling flow of cooling fluid from said radiator output conduit system and said radiator bypass conduit system to said cylinder block inlet of said block cooling jacket according to a block flow regulation signal; and (m) a controller, which receives said sensed block output temperature signal from said block output fluid temperature sensor, and which produces, based thereon, said radiator flow regulation signal which is sent to said first control valve, and also said block flow regulation signal which is sent to said second control valve.

With such a structure, a method of operation according to the present invention may be practiced, by a method for operating the cooling system described above, when said cooling system is filled with cooling fluid, comprising the processes, simultaneously performed, of: (n) operating said first pump and said second pump; and (o) depending upon said sensed block output temperature signal from said block output fluid temperature sensor, performing either one or the other but not both of the following two processes (p) and (q): (p) if said sensed block output temperature signal from said block output fluid temperature sensor indicates a cooling fluid temperature at said cylinder block outlet of said block cooling jacket of less than a certain predetermined temperature value, then simultaneously: (p1) controlling said first control valve, by said radiator flow regulation signal from said controller, so as substantially to interrupt flow of cooling fluid through said radiator; and (p2) controlling said second control valve, by said block flow regulation signal, so as to allow a flow of cooling fluid through said radiator bypass conduit system from a downstream part of said main recirculation conduit system to said cylinder block inlet of said block cooling jacket; (q) if said sensed block output temperature signal from said block output fluid temperature sensor indicates a cooling fluid temperature at said cylinder block outlet of said block cooling jacket of greater than said predetermined temperature value, then simultaneously: (q1) controlling said first control valve, by said radiator flow regulation signal from said controller, so as to allow cooling fluid to flow through said radiator; (q2) controlling said second control valve, by said block flow regulation signal, so as to allow a controlled flow of cooling fluid from said radiator and said radiator output conduit system also to said cylinder block inlet of said block cooling jacket.

According to such a mode of operation, when the internal combustion engine has not yet warmed up, or when the cylinder block is not as warm as could be desired in view of the objects set out above, then the sensed temperature signal from the block output fluid temperature sensor will indicate a cooling fluid temperature of the cylinder block of less than the predetermined temperature value. In this case, the controller produces such a radiator flow regulation signal to the first control valve as to cause said valve substantially to interrupt flow of cooling fluid through the radiator, and also produces such a block flow regulation signal to the second control valve as to allow a flow of cooling fluid through the radiator bypass conduit system from a downstream part of the main recirculation conduit system to the cylinder block inlet of the block cooling jacket. Since the first and the second pumps are operating, thereby cooling fluid is driven into the inlets of the cylinder head cooling jacket and the cylinder block cooling jacket, through these jackets to cool respectively the cylinder head and the cylinder block, and out through their outlets. These flows of cooling fluid come together when they enter the main recirculation conduit system, and mix as they flow down said main recirculation conduit system. This flow of cooling fluid cannot enter the radiator, because of the intercepting effect of the first control valve; but it instead flows into the radiator bypass conduit system, which leads it (albeit with a certain relatively high flow resistance) both to the cylinder head cooling jacket inlet, and also to the cylinder block cooling jacket inlet, via the second control valve. Thus, no cooling action is provided at this time for the internal combustion engine as a whole, but the action of the cooling system according to the present invention as described above is only to redistribute heat from the cylinder head to the cylinder block, by this mixing of the flows of cooling fluid which pass through the cylinder head and the cylinder block. Accordingly, the cylinder block is warmed up quickly, which as stated above is very beneficial.

On the other hand, when the internal combustion engine is fully warmed up, then the sensed temperature signal from the block output fluid temperature sensor will indicate a cooling fluid temperature of the cylinder block of higher than the predetermined temperature value. In this case, the controller produces such a radiator flow regulation signal to the first control valve as to cause said valve to allow cooling fluid to flow through the radiator, and also produces such a block flow regulation signal to the second control valve as to allow a controlled or restricted flow of cooling fluid through the radiator output conduit past said second control valve to the inlet of the cylinder block cooling jacket. Thus, because this flow is controlled or restricted, thereby some of the cooling fluid which is being expelled from the cylinder block cooling jacket by the action of the second pump is diverted, not into the main recirculation conduit system, but instead into the block recirculation conduit system, along which said flow passes to be supplied to the inlet of the cylinder block cooling jacket, without being passed through the radiator for cooling. Accordingly, the cylinder block cooling jacket is partially supplied with cooling fluid which has not been cooled by the radiator, and thus the temperature of the cylinder block is caused to be higher than that of the cylinder head. Further, because some of the capacity of the radiator which otherwise would have been used to cool the cylinder block is now available, the cylinder head can be kept cooler at this time, than would be the case if all the cooling fluid which had passed through the cylinder block jacket were then passed through the radiator for cooling. By the controller varying the amount of opening of the second control valve, furthermore, the proportion of the cooling fluid flow through the cylinder block cooling jacket which has passed through the radiator can be varied; and accordingly the temperature of the cylinder block can be adjusted, according to circumstances.

BRIEF DESCRIPTION OF THE DRAWINGS

The present invention will now be shown and described with reference to several preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings:

DESCRIPTION OF THE PREFERRED EMBODIMENTS

The present invention will now be described in terms of several preferred embodiments thereof, and with reference to the accompanying drawings.

Figure 1:
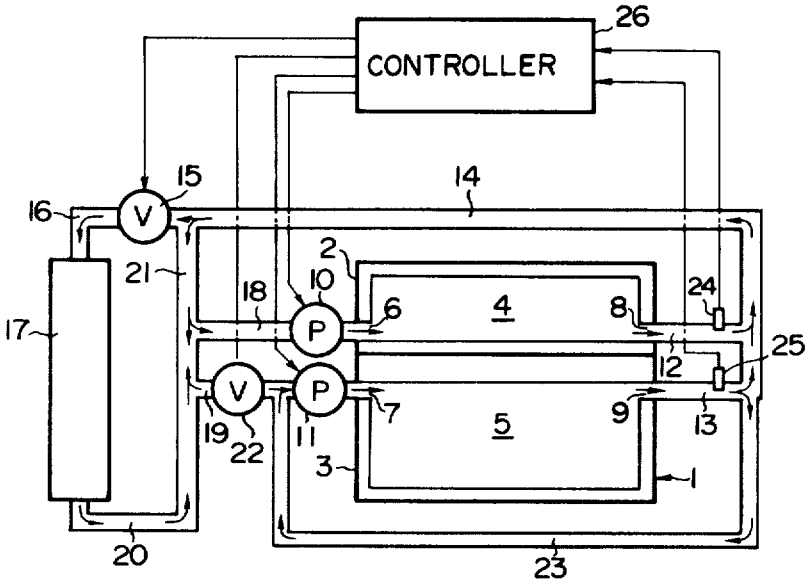
FIG. 1 is a diagrammatical illustration, showing a first preferred embodiment of the cooling system according to the present invention, in which the delivery rates of two pumps thereof are controlled, and a temperature sensor is provided to a cylinder head outlet thereof, in addition to the aforementioned cylinder block outlet temperature sensor.

FIG. 1 is a diagrammatical view, showing an internal combustion engine which is equipped with a first preferred embodiment of the cooling system according to the present invention, and to which a first preferred embodiment of the method for cooling according to the present invention can be applied. In this figure, the reference numeral 1 denotes the internal combustion engine, which comprises a cylinder head 2 and a cylinder block 3.

The internal combustion engine 1 includes at least one combustion chamber, which is not shown, and the cylinder head 2 defines the upper part of this combustion chamber, i.e. the part thereof in which the compression and the ignition occurs, and the surface of which upper part therefore receives the greater proportion of the heat generated in said combustion chamber. The cylinder head 2 is formed with a head cooling jacket 4 which extends close to a large part of said upper part of said combustion chamber, so as, when said head cooling jacket 4 is filled with cooling fluid such as water, to cool said upper part of said combustion chamber, and said cylinder head 2. Typically, the internal combustion engine 1 will in fact define several such combustion chambers, and the head cooling jacket 4 will extend past the upper parts of each of these combustion chambers. Cooling fluid is supplied into the head cooling jacket 4 through a cylinder head inlet 6, and is taken out from the head cooling jacket 4 through a cylinder head outlet 8.

Similarly, the cylinder block 3 is formed with a block cooling jacket 5 which extends close to a large part of the wall side defining surface of said combustion chamber, so as, when said block cooling jacket 5 is filled with cooling fluid, to cool said side wall part of said combustion chamber, and said cylinder block 5. Again, of course, typically the cylinder block 5 will in fact define several such combustion chamber walls or bores, and the block cooling jacket 5 will extend past the side wall parts of each of these bores. Cooling fluid is supplied into the block cooling jacket 5 through a cylinder block inlet 7, and is taken out from the block cooling jacket 5 through a cylinder block outlet 9.

Further, a cooling radiator 17 of a conventional sort, formed with an inlet at its upper portion and an outlet at its lower portion, is provided for the internal combustion engine 1.

As has been previously explained, during operation of the internal combustion engine 1, the major portion of the heat generated in the combustion chambers thereof is communicated to the cylinder head 2, and only a minor portion of the heat generated in the combustion chambers is communicated directly to the cylinder block 3 of the internal combustion engine 1. Therefore, an imbalance of heating occurs between the cylinder head 2 and the cylinder block 3, and a first preferred embodiment of the cooling system according to the present invention for cooling the internal combustion engine 1, along with a first preferred embodiment of the method for cooling according to the present invention, practiced by said first preferred cooling system embodiment, will now be explained.

A cylinder head pump 10 is provided proximate to the cylinder head inlet 6, for impelling cooling fluid through the head cooling jacket 4 from the cylinder head inlet 6 to the cylinder head outlet 8; and, similarly, a cylinder block pump 11 is provided, proximate to the cylinder block inlet 7, for impelling cooling fluid from the cylinder block inlet 7 towards the cylinder block outlet 9. In the shown first preferred embodiment of the cooling system according to the present invention, this cylinder head pump 10 and this cylinder block pump 11 are controllable with regard to their rotational speeds, and with regard to their delivery rates, as will be explained hereinafter; but this is not essential to the present invention. To the cylinder head outlet 8 there is connected a head output conduit 12, and to the cylinder block outlet 9 there is connected a block output conduit 13. The ends remote from the internal combustion engine 1 of the head output conduit 12 and of the block output conduit 13 are both communicated to the upstream end of a main recirculation conduit 14, which is of relatively low flow resistance, and whose downstream end is connected to the input of a radiator flow regulation valve 15. The outlet of this valve 15 is connected to the upstream end of a radiator input conduit 16, and the downstream end of this conduit 16 is connected to the inlet of the radiator 17. The outlet of the radiator 17 is connected to the upstream end of a radiator output conduit 20, whose downstream end is connected to the upstream end of a head input conduit 18 and also to the upstream end of a block input conduit 19. The downstream end of the head input conduit 18 is directly connected to the input of the cylinder head pump 10, and the downstream end of the block input conduit 19 is connected to the input of the cylinder block pump 11.

At an intermediate point along the block input conduit 19 there is provided a block transfer flow regulation valve 22, which regulates the flow rate of cooling fluid through said block input conduit 19. The upstream end of a radiator bypass conduit 21, which is somewhat restricted and has a relatively high resistance to flow of cooling fluid, is connected to a downstream part of the main recirculation conduit 14, quite close to the downstream end of the main recirculation conduit 14 which is connected to the inlet of said radiator flow regulation valve 15. The downstream end of this radiator bypass conduit 21 is communicated to the upstream end of the head input conduit 18 and also to the upstream end of the block input conduit 19. Finally, between the end of the block output conduit 13 remote from the internal combustion engine 1, i.e. the downstream end of the block output conduit 13, and a part of the block input conduit 19 downstream of said block transfer flow regulation valve 22 mounted at said intermediate position therein, there is provided a direct block recirculation conduit 23, which is somewhat restricted and has a relatively high resistance to flow of cooling fluid, and which accordingly communicates the cylinder block outlet 9 directly to the inlet of the cylinder block pump 11, bypassing the radiator 17.

The radiator flow regulation valve 15 and the block transfer flow regulation valve 22 are controlled by means of valve control signals which are sent to them, which will hereinafter be explained. In the shown preferred embodiment of the cooling system according to the present invention, in fact, these valve control signals are electrical signals, and the radiator flow regulation valve 15 and the block transfer flow regulation valve 22 may be diaphragm actuated cooling fluid valves, their diaphragms being actuated by supply of inlet manifold vacuum thereto which is controlled by electrically controlled vacuum switching valves of per se well known sorts. However, in alternative embodiments, the radiator flow regulation valve 15 and the block transfer flow regulation valve 22 might be directly actuated by supply of electrical energy thereto, via linear motors, solenoids, or the like; this would be quite within the scope of the present invention.

In the head output conduit 12 there is mounted a head output fluid temperature sensor 24, which senses the temperature of the cooling fluid which is passing out from the cylinder head outlet 8 through said head output conduit 12, and which generates a sensed temperature signal representative thereof; and, similarly, in the block output conduit 13 there is mounted a block output fluid temperature sensor 25, which senses the temperature of the cooling fluid which is passing out from the cylinder block outlet 9 through said block output conduit 13, and which generates a sensed temperature signal representative thereof. The sensed temperature signals output from these sensors 24 and 25 are sent to a controller 26. This controller 26 may, in the simplest case, be a simple electrical switching system incorporating relays, solenoids, and the like, constructed in a fashion which will be readily conceived of by a person of ordinary skill in the art pertaining thereto, based upon the disclosure of the function of said controller 26 which is contained hereinafter; but, in fact, in the shown first preferred embodiment of the cooling system according to the present invention this controller 26 is an on board computer, incorporating a microprocessor, and this computer also, in a time shared fashion, performs various other regulatory functions for the internal combustion engine 1. However, the use of such a computer incorporating a microprocessor is not essential.

Thus, the controller 26 receives the sensed temperature signals from the head output fluid temperature sensor 24 and from the block output fluid temperature sensor 25, and, based thereupon, outputs the valve control electrical signals for controlling the radiator flow regulation valve 15 and the block transfer flow regulation valve 22, and, in the shown first preferred embodiment of the cooling system according to the present invention, also outputs pump control electrical signals for controlling the rotational speeds of the cylinder head pump 10 and of the cylinder block pump 11, according to control logic which will be explained hereinafter. In fact, as will appear in the discussion of the preferred embodiment of the cooling system according to the present invention shown in FIG. 5, such control of the rotational speeds of the cylinder head pump 10 and of the cylinder block pump 11 as performed by the controller 26 is not essential to the present invention, and, in fact, the provision of the head output fluid temperature sensor 24 is not essential to the present invention either, although the provision of the block output fluid temperature sensor 25 is essential.

Now, the operation of the first preferred embodiment of the cooling system according to the present invention described above will be explained.

Effectively, the controller 26 recognizes two distinct operational conditions for the internal combustion engine 1, according to the sensed temperature signal received from the block output fluid temperature sensor 25, and provides, in these two different operational conditions, different forms of control for the radiator flow regulation valve 15, the block transfer flow regulation valve 22, and the pumps 10 and 11, via the valve and pump control signals therefor. Further, according to the operation of the shown first preferred embodiment of the cooling system according to the present invention shown in FIG. 1, the transition between these two operational conditions is performed in a particular manner, as will hereinafter be explained.

First, if the sensed temperature signal from the block output fluid temperature sensor 25 indicates a temperature of the cooling fluid passing out from the cylinder block outlet 9 of less than a certain predetermined temperature value, which for example may be 90° C., then it is considered, according to this first preferred embodiment of the cooling method according to the present invention, that the internal combustion engine 1 is being warmed up from the cold condition. At this time, the controller 26 generates valve control signals for the radiator flow regulation valve 15 and the block transfer flow regulation valve 22 which cause the radiator flow regulation valve 15 to be completely closed, and which cause the block transfer flow regulation valve 22 to be completely opened. The controller 26 also generates a control signal for the cylinder head pump 10 which causes the cylinder head pump 10 to operate at a low rotational speed, for example at a rotational speed which will provide a delivery rate of 10 liters of cooling fluid per minute to the cylinder head inlet 6 of the head cooling jacket 4. Further, the controller 26 generates a control signal for the cylinder block pump 11, based upon the sensed temperature signals both from the head output fluid temperature sensor 24 and from the block output fluid temperature sensor 25, which causes the cylinder block pump 11 to rotate at as low a rotational speed as possible, i.e. at as low a delivery rate of cooling fluid as possible, consistent with maintaining the temperature of the cooling fluid which is passing out from the cylinder block outlet 9 within a certain predetermined small range of the temperature of the cooling fluid which is passing out from the cylinder head outlet 8. For example, in the shown first preferred embodiment of the cooling system according to the present invention, this range may be 1° C.

In other words, if the sensed temperature signal provided by the block output fluid temperature sensor 25, representative of the temperature of the cooling fluid which is being expelled from the block cooling jacket 5 through the cylinder block outlet 9, is different from the sensed temperature signal provided by the head output fluid temperature sensor 24, which is representative of the temperature of the cooling fluid which is being expelled from the head cooling jacket 4 through the cylinder head outlet 8, by an amount which indicates a temperature difference of greater than 1° C., then the controller 26 generates a control signal for the cylinder block pump 11 which causes the cylinder block pump 11 to provide a larger amount of flow of cooling fluid than the current flow amount; but, on the other hand, if then sensed temperature signal provided by the block output fluid temperature sensor 25 is different from the sensed temperature signal provided by the head output fluid temperature sensor 24 by an amount which indicates a temperature difference of less than 1° C., then the controller 26 generates a control signal for the cylinder block pump 11 which causes the cylinder block pump 11 to produce a lower amount of flow of cooling fluid than the current flow amount, although preferably not a zero flow. Details of this feedback control system can easily be filled in by one of ordinary skill in the control art, based upon the above explanation.

This control of the rotational speed of the cylinder head pump 10 and of the rotational speed of the cylinder block pump 11, i.e. of the delivery rates of the cylinder head pump 10 and of the cylinder block pump 11, is not essential to the present invention, but is specific to the shown first preferred embodiment of the cooling system according thereto. As will be seen from the preferred embodiment of the cooling system according to the present invention, shown in FIG. 5 and described hereinafter, the present invention will work without such control. However, such control of pump rotational speeds is very beneficial, for reasons which will be explained hereinafter.

The effect of this mode of operation provided by the controller 26 is that, since the radiator flow regulation valve 15 is kept completely closed by the valve control signal fed thereto, no fluid flow can occur at this time through the radiator input conduit 16, the radiator 17, and the radiator output conduit 20. In this connection, it should be understood that the provision of the radiator flow regulation valve 15 is at an intermediate part of the radiator output conduit 20, instead of in a position as shown in FIG. 1 between the downstream end of the main recirculation conduit 14 and the inlet of the radiator 17, would be consistent with the principles of the present invention, as providing the same function. Therefore, the flows of cooling fluid from the cylinder head outlet 8 and from the cylinder block outlet 9 through the head output conduit 12 and through the block output conduit 13, which join together at the upstream end of the main recirculation conduit 14, flow together down along the main recirculation conduit 14, mixing therein with one another, and then flow through the restricted radiator bypass conduit 21 to be supplied to the inlet side of the cylinder head pump 10, and, since the block transfer flow regulation valve 22 is at this time, as stated above, wide open, also to the inlet side of the cylinder block pump 11. In this connection, it should be understood that a certain amount of this fluid flow, instead of entering the upstream end of the main recirculation conduit 14, is diverted downwards in FIG. 1 into the upstream end of the block recirculation conduit 23, and passes along this block recirculation conduit 23 to be supplied to the inlet side of the cylinder block pump 11; but, since the block recirculation conduit 23 is restricted, and, particularly, offers a greater resistance to flow of cooling fluid than does the radiator bypass conduit 21, the majority of the recirculation of cooling fluid from the cylinder head outlet 8 and from the cylinder block outlet 9 to the cylinder head inlet 6 and the cylinder block inlet 7 occurs via the main recirculation conduit 14 and the radiator bypass conduit 21.

Of course, at this time, no cooling action at all is provided in this mode of operation by the cooling system according to the present invention to the internal combustion engine 1 as a whole, because the radiator 17 is receiving no flow of cooling fluid; and the operation of the shown first preferred embodiment of the cooling system according to the present invention is only to redistribute heat, which is being produced by combustion within the combustion chambers of the internal combustion engine 1, from the cylinder head 2 thereof which receives most of the generated heat, to the cylinder block 3 thereof which receives a minor part of the generated heat. In this connection, it will be understood that the low delivery rate provided at this time by the cylinder head pump 10 is so arranged, because no very high speed flow of cooling fluid is necessary at this time through the head cooling jacket 4, since it is intended that the internal combustion engine 1 as a whole should heat up, and no cooling action therefor is required. Accordingly, the delivery rate of the cylinder head pump 10 is restricted at this time, in order to conserve mechanical energy. As a result, the warming up characteristic of the cylinder block 3 is much improved, as compared with the case in which the cooling system for the cylinder head 2 is entirely separated from the cooling system for the cylinder block 3. Since it is desirable to raise the temperature of the cylinder block 3 fairly quickly from the cold condition, in order to minimize frictional losses during the warming up process of the internal combustion engine by heating up the lubricating oil contained within it as quickly as possible, and also in order to minimize fuel utilization during engine warmup, and in order to minimize engine wear, especially cylinder bore wear, before the engine block is fairly hot, as explained above, as well as to minimize the emission of improperly combusted hydrocarbons in the exhaust gases of the engine when it is being operated in the cold condition, the above described construction according to the first preferred embodiment of the cooling system according to the present invention is very advantageous.

On the other hand, if the sensed temperature signal produced by the block output fluid temperature sensor 25 indicates that the temperature of the cooling fluid flowing out from the block cooling jacket 5 through the cylinder block outlet 9 is greater than the above mentioned predetermined temperature value, i.e. in this case 90° C., then in this second operational condition the controller 26 generates a different set of control signals, as follows. The valve control signal output to the radiator flow regulation valve 15 at this time is such as to keep the radiator flow regulation valve 15 completely open. Thus, cooling fluid is now allowed to pass through the radiator flow regulation valve 15 without encountering any substantial flow resistance into the radiator input conduit 16. Further, in the first preferred embodiment, the rotational speed of the cylinder head pump 10 is raised, for example to a rotational speed which gives a delivery rate of 30 liters of cooling fluid per minute to be supplied into the head cooling jacket 4. This increased delivery rate provided by the cylinder head pump 10 is in order to provide a high speed of flow of cooling fluid through the head cooling jacket 4, in order well to cool the cylinder head 2, in which a substantial amount of heat is being generated at this time.

Thus, cooling fluid which has passed through the head cooling jacket 4 and has been heated therein flows out through the cylinder head outlet 8, through the head output conduit 12, into the upstream end of the main recirculation conduit 14, and along through the main recirculation conduit 14 to its downstream end, whence it mostly enters into the inlet of the radiator flow regulation valve 15. The radiator flow regulation valve 15 is wide open, and accordingly this cooling fluid flows out of the outlet of the radiator flow regulation valve 15, through the radiator input conduit 16, and into the inlet of the radiator 17. This flow of cooling fluid is then cooled within the radiator 17 in a per se well known fashion, and passes out of the outlet of the radiator 17 into the upstream end of the radiator output conduit 20. From the radiator output conduit 20, much of this cooling fluid passes through the head input conduit 18 to be supplied to the inlet of the cylinder head pump 10, which pumps it into the cylinder head inlet 6, whence it is returned to the head cooling jacket 4.

In this second or hot operational condition, a certain part of the cooled cooling fluid which is being returned through the radiator output conduit 20 from the radiator 17 is supplied into the block input conduit 19 to be sucked in by the inlet of the cylinder block pump 11, as will be explained hereinafter; and, further, a part of the hot cooling fluid which is passing through the main recirculation conduit 14, instead of passing into the inlet of the radiator flow regulation valve 15 towards the radiator 17, instead is diverted through the radiator bypass conduit 21 to be supplied, without being cooled, to the inlet of the cylinder head pump 10; but this bypass flow of cooling fluid is relatively small, because it is so arranged that the flow resistance of the radiator bypass conduit 21 is substantially higher than the flow resistance of the combination of the radiator flow regulation valve 15, the radiator input conduit 16, the radiator 17, and the radiator output conduit 20. Accordingly, the majority of flow of cooling fluid occurs through the radiator 17, and this larger flow is cooled thereby. It will of course be understood by one skilled in the art that the flow resistance of the radiator bypass conduit 21, and accordingly the flow rate of the cooling fluid flowing through the radiator bypass conduit 21, may be suitably set by properly varying the construction of the radiator bypass conduit 21, i.e. its cross section. Further, it should be understood that this is another subsidiary reason for increasing the delivery rate of the cylinder head pump 10, because when the cylinder head pump 10 is providing a high rate of delivery of cooling fluid then this high flow rate cannot all be accomodated by the radiator bypass conduit 21, and accordingly it is ensured that a large proportion of this cooling fluid will pass through the radiator flow regulation valve 15 and thence through the radiator 17 to be cooled.

A particular special feature of the shown first preferred embodiment of the cooling system according to the present invention is that, on transition from the first above described operational condition in which the sensed temperature signal produced by the block output fluid temperature sensor 25 indicates a block cooling fluid temperature of less than the predetermined temperature value, to the second above described operational condition, wherein said sensed temperature signal indicates a block cooling fluid temperature of greater than said predetermined temperature value, the controller 26 initially produces a valve control signal for the radiator flow regulation valve 15, which does not immediately fully open said valve 15 from its previously fully closed condition, but instead which gradually opens the radiator flow regulation valve 15 over a time period of, for example, one minute. This is because the conduit system comprising the radiator input conduit 16, the radiator 17, and the radiator output conduit 20 contains a substantial amount of cooling fluid, which, during the first operational condition described above, is quite cold; and, if the radiator flow regulation valve 15 were to be suddenly opened from the fully closed condition, then a sudden rush of cold cooling fluid through the radiator output conduit 20 would occur, and this sudden rush of cold cooling fluid would be immediately sucked in by the cylinder head pump 10 and driven into the head cooling jacket 4. This would cause a sudden thermal shock to the cylinder head 2, and might well deteriorate its durability, or even crack it. Accordingly, in order to avoid this, the controller 26 provides a control signal for the radiator flow regulation valve 15 which gradually opens said valve 15 over a certain time period, and accordingly the switching over from the condition wherein all of the flow of cooling fluid which occurs through the main recirculation conduit 14 is passed through the radiator bypass conduit 21 to be directly recirculated to the head cooling jacket 4, to the condition in which most of the flow of cooling fluid through the main recirculation conduit 14 passes through the radiator 17 to be cooled, occurs gradually, and accordingly thermal shock to the cylinder head 2 is minimized. This is a very useful specialization of the present invention.

Further, in this second operational condition, wherein the sensed temperature signal output by the block output fluid temperature sensor 25 indicates a block cooling fluid temperature of greater than the predetermined value, the controller 26 outputs a pump control signal to the cylinder block pump 11 which causes the cylinder block pump 11 to rotate at a rotational speed which provides an increased flow of cooling fluid therethrough, for example a flow of 20 liters of cooling fluid per minute. It should be noted that this increasing of the rotational speed of the cylinder block pump 11 is not absolutely essential to the present invention, but is a useful specialization available in this first preferred embodiment thereof. Further, at this time, the controller 26 outputs a valve control signal to the block transfer flow regulation valve 22 which controls it in the following manner.

When the sensed temperature signal received by the controller 26 from the block output fluid temperature sensor 25 indicates a temperature of the cooling fluid flowing out from the cylinder block outlet 9 of less than a second predetermined temperature value, which is higher than the above mentioned first predetermined temperature value which in this first preferred embodiment was 90° C., and for instance may be 100° C., then the controller 26 outputs a control signal to the block transfer flow regulation valve 22 which causes said valve 22 to be almost or completely closed, and accordingly in this condition little or no cooled cooling fluid can flow from the radiator output conduit 20 into the upstream end of the block input conduit 19 and down past the block transfer flow regulation valve 22, which is situated in an intermediate position within the block input conduit 19, to flow into the inlet of the cylinder block pump 11 and from the outlet thereof into the block cooling jacket 5. Accordingly, by the action of the cylinder block pump 11, most of the flow of cooling fluid through the block cooling jacket 5 is forced into the upstream end of the restricted block recirculation conduit 23, and passes down through the block recirculation conduit 23 to be supplied from its downstream end to the inlet of the cylinder block pump 11, without being substantially cooled. Of course, an amount of cooling fluid is diverted from the downstream end of the block output conduit 13, to pass into the upstream end of the main recirculation conduit 14, instead of passing into the upstream end of the block recirculation conduit 23, of the same amount, as the amount of cooled cooling fluid which is allowed to pass from the radiator output conduit 20 into the block input conduit 19 and past the block transfer flow regulation valve 22 to be taken in by the inlet of the cylinder block pump 11, but in this case this amount is a minor proportion of the total. Accordingly, since most of the cooling fluid which is passing through the block cooling jacket 5 is being recirculated to the inlet of the cylinder block pump 11 to be returned into the block cooling jacket 5 without being cooled, thereby the temperature of the cooling fluid within the block cooling jacket 5 and at the cylinder block outlet 9 thereof increases.

On the other hand, when the sensed temperature signal received by the controller 26 from the block output fluid temperature sensor 25 indicates a temperature of the cooling fluid flowing out from the cylinder block outlet 9 of greater than said second predetermined temperature value, then the controller 26, based thereupon, generates a valve control signal which controls the block transfer flow regulation valve 22 to be much more opened, so that a substantially greater amount of cooled cooling fluid passes from the radiator output conduit 20 into the block input conduit 19 and past the block transfer flow regulation valve 22 to be sucked in by the inlet of the cylinder block pump 11, and driven thereby into the block cooling jacket 5. At this time, because the block recirculation conduit 23 is restricted, and has a fairly high resistance to flow of cooling fluid, the majority amount of the flow of cooling fluid which is being expelled through the cylinder block outlet 9 into the block output conduit 13 passes from the downstream end of the block output conduit 13 into the upstream end of the main recirculation conduit 14 to pass towards the radiator 17, and only a minor part of this cooling fluid passes into the upstream end of the block recirculation conduit 23 to be recirculated into the inlet of the cylinder block pump 11 without being cooled. Accordingly, a large proportion of the flow of cooling fluid through the block cooling jacket 5 is cooled by being passed through the radiator 17, and accordingly the temperature of the cooling fluid within the block cooling jacket 5 drops.

By the combination of these two actions, therefore, in a feedback manner, the temperature of the cooling fluid within the block cooling jacket 5 is maintained substantially to be at the second above described predetermined temperature value, which in the shown first embodiment is 100° C. This means that the temperature of the cylinder block 3 as a whole is maintained substantially at the second predetermined temperature value, i.e. in the shown first preferred embodiment, 100° C., which is of course substantially higher than the temperature at which the cylinder head 2 is being maintained at this time, since the cooling fluid which is circulating through the head cooling jacket 4 is to a very large extent, as described above, cooling fluid which has passed through the radiator 17 to be cooled. Accordingly, by thus keeping the cylinder head substantially cooler than the cylinder block during warmed up operation of the internal combustion engine, the cylinder block may be kept significantly hotter than is possible with a conventional cooling system in which the head cooling fluid and the block cooling fluid are both always passed through the same radiator and cooled. Further, the temperature of the lubricating oil contained within the internal combustion engine 1 is at this time kept at at least the temperature of the cylinder block 3, and in fact is maintained at a significantly higher temperature, due to the dissipation of mechanical energy therein. Of course, by keeping the cylinder head as cool as possible, and by using as much of the capacity of the radiator 17 as possible for cooling the cylinder head, the possibility of the occurrence of knocking in the engine is greatly reduced. The keeping of the cylinder block as hot as possible within a predetermined limit, i.e. substantially at the second predetermined temperature value, ensures that frictional losses in the engine are kept as low as possible, and also is beneficial with regard to the minimization of the amount of improperly combusted hydrocarbons which are emitted in the exhaust gases of the engine. Further, in contrast to a conventional type of cooling system as discussed above which uses completely separate cooling systems for the cylinder head and for the cylinder block, the full capacity of the radiator 17 can be effectively utilized, according to the first embodiment of the present invention described above, because of the flexibility available for determining the proportions of the cooling capacity of the radiator which can be allocated to the cylinder head and to the cylinder block for cooling them.

It should be understood that, in the shown first preferred embodiment of the cooling system according to the present invention, the provision of the head output fluid temperature sensor 24 is not strictly necessary. This sensor 24 is only used, in the mode of operation described above according to the first preferred embodiment of the cooling method according to the present invention, in the first operational condition when the internal combustion engine 1 is not fully warmed up, i.e. when the sensed temperature signal from the block output fluid temperature sensor 25 indicates a block cooling fluid temperature of less than the first predetermined temperature value. As described above, according to this first embodiment, the cylinder block pump 11 is operated at this time at as low a rotational speed, and at as low a delivery flow rate, as possible, provided that the temperature of the cooling fluid flowing out through the cylinder head outlet 8, and the temperature of the cooling fluid flowing out through the cylinder block outlet 9, are kept within a certain predetermined small range of one another, for example 1° C.; and this is beneficial, in order to minimize utilization of mechanical energy by the cylinder block pump 11; but, if no such sensor as the head output fluid temperature sensor 24 is provided, then it is perfectly within the principles of the present invention for the cylinder block pump 11 to be operated at a sufficiently high rotational speed, and a sufficiently high cooling fluid delivery rate, to ensure that the temperature of the cooling fluid within the block cooling jacket 5 is kept within a proper small range of the cooling fluid within the head cooling jacket 4; a non controlled operation of the cylinder block pump 11 in this way, without such feedback control as described above, will use somewhat more mechanical energy, but will be perfectly practicable, and the proper value for such a sufficiently high rotational speed may be determined by experiment.

Now, a second method for cooling according to the present invention, which may be practiced by the first preferred embodiment of the cooling system according to the present invention described above, will be explained. This particular second method of cooling is appropriate to the case in which the proper operation of a heater fitted to an automobile which incorporates the internal combustion engine 1 is of paramount importance, and particularly is applicable to the case in which the constancy of the operation of such a heater is an important consideration. Thus, this second method of operation is appropriate to an automobile which is to be operated in cold climatic conditions.

First, a difficulty in the operation of a heater, if the cooling system according to the first preferred embodiment of the cooling system according to the present invention described above is operating in the first above described mode of operation, will be explained. Generally, such a heater is provided with a supply of cooling fluid from the block cooling jacket 5 of the cylinder block 3, in order to best provide heat radiation from this heater, because the cooling fluid within the block cooling jacket 5 of the cylinder block 3 is, as explained above, kept hotter than the cooling fluid in the head cooling jacket 4 of the cylinder head 2, during warmed up operation of the internal combustion engine 1. In other words, as may be exemplarily seen in FIG. 3, which relates to a third preferred embodiment of the cooling system according to the present invention, such a heater is customarily supplied with cooling fluid which has been diverted from the block recirculation conduit 23. If, now, the exterior operating conditions for the internal combustion engine 1 are very cold, then the heat radiated out from such a heater will have a considerable effect with regard to cooling the internal combustion engine 1. In fact, if the heat radiated from such a heater is sufficient for cooling the cylinder block 3, i.e. for keeping the temperature of the cooling fluid contained within the block cooling jacket 5 of the cylinder block 3, as measured by the block output fluid temperature sensor 25 provided at the cylinder block outlet 9 thereof, at the above defined second predetermined temperature value, which in the shown example is 100° C., then the block transfer flow regulation valve 22 will be closed completely by the controller 26, so that no transfer of cooling fluid from the circulation system comprising the cooling radiator 17, the head cooling jacket 4 of the cylinder head 2, etc., will be transferred to the block cooling jacket 5 of the cylinder block 3. Thus, at this time, the cooling fluid contained within the block cooling jacket 5 of the cylinder block 3 will only be recirculated around the conduit system comprising the cylinder block outlet 9, the block output conduit 13, the block recirculation conduit 23, the heater which is branched off from the block recirculation conduit 23, the cylinder block pump 11, and the cylinder block inlet 7. Now, suppose that the heater radiates such a large amount of heat energy from this cooling fluid circulation system that the temperature of the cooling fluid within the block cooling jacket 5, as measured by the block output fluid temperature sensor 25 at the cylinder block outlet 9 thereof, is lowered to below the first above defined predetermined temperature, which in this example is 90° C. In this case, then, according to the above described first mode of operation of the first preferred embodiment of the cooling system according to the present invention described above, the controller 26 will close the radiator flow regulation valve 15, and this is desirable, since the disablement of the cooling effect of the cooling radiator 17 provided thereby will ensure that the internal combustion engine 1 as a whole warms up in due course, as is necessary; but, further, the controller 26 will open the block transfer flow regulation valve 22 wide, which thus will fully communicate the cooling fluid contained within the block cooling jacket 5 of the cylinder block 3 and being supplied to the heater, to the cooling fluid contained within the head cooling jacket 4 of the cylinder head 2, the main recirculation conduit 14, the radiator bypass conduit 21, etc.. It is to be expected, as a matter of course, that this latter mentioned cooling fluid, which has been used to keep the cylinder head 2 as cool as possible, will be in a very cold condition at this time, because, if the heat radiated by the heater is sufficient to keep the temperature of the cooling fluid in the block cooling jacket 5 of the cylinder block 3 down to the first predetermined temperature value, then presumably the exterior conditions are very cold, and therefore the cooling radiator 17 will function very effectively. Accordingly, when the block transfer flow regulation valve 22 is suddenly opened, a rush of cold cooling fluid from the cooling system for cooling the cylinder head 2 will be provided into the block cooling jacket 5 of the cylinder block 3, and will enter into the block recirculation conduit 23 and also will enter into the heater which is branched off therefrom. Accordingly, the heater operation may be stopped completely for a certain time, and in any case will be seriously deteriorated. Of course, after a certain time, because the cooling radiator 17 is not being used for cooling at all in this operational mode, the internal combustion engine 1 as a whole will warm up, and the heater will start to work again; but for a certain intermediate time the heater operation will be seriously adversely affected, which is very undesirable.

Thus, in order to avoid this problem, according to the second method of cooling according to the present invention as performed by the first preferred embodiment of the cooling system according to the present invention, during warmed up operation of the internal combustion engine 1 while the block output fluid temperature sensor 25 at the cylinder block outlet 9 is detecting a temperature of the cooling fluid which is being expelled from the block cooling jacket 5 which is higher than the first predetermined temperature value, at least in cold weather conditions when there is a chance of the above described problem occurring, the controller controller 26 sends such a valve control signal to the radiator flow regulation valve 15, based upon the sensed temperature signal from the head output fluid temperature sensor 24 relating to the temperature of the cooling fluid in the head cooling jacket 4 of the cylinder head 2, as to keep the temperature of the cooling fluid in the cylinder head 2 substantially at a predetermined head cooling fluid temperature value, which in the shown example may be 30° C. Thus, in this case, if the above described sudden opening of the block transfer flow regulation valve 22 occurs, the sudden rush of cooling fluid which is directed into the cooling system for the cylinder block 3 at this time is not composed of extremely cold cooling fluid, and accordingly the operation of the heater is deteriorated much less than would otherwise be the case.

This control of the temperature of the cooling fluid within the head cooling jacket 4 of the cylinder head 2, as sensed by the head output fluid temperature sensor 24 provided in the cylinder head outlet 8, may be performed in a feedback manner by the controller 26, according to per se well known modes of control, the details of which can easily be conceived of by a person skilled in the control art, based upon the explanation above.

Now, a third method of cooling according to the present invention, which may be practiced by the first preferred embodiment of the cooling system according to the present invention described above, will be explained. This particular method of cooling is appropriate to the case in which it is important to obtain the intake mixture vaporization effect, which has been explained above in the section of this specification entitled "BACKGROUND OF THE INVENTION". For example, this method of operation is appropriate to operation of the internal combustion engine 1 in cold climatic conditions, and at such a time can significantly reduce the necessity, during warming up of the internal combustion engine 1, for the utilization of a choke provided in a carburetor of the internal combustion engine 1, or, if the internal combustion engine 1 is provided with a fuel injection system, for increasing the amount of fuel injected to the combustion chambers of the internal combustion engine 1.

According to this third method of cooling according to the present invention, it is considered to be of paramount importance that the cylinder head 2 of the internal combustion engine 1 should be heated up as quickly as possible, during the initial stages of operation of the internal combustion engine 1 from the cold condition; in more detail, the cylinder head 2 should be warmed up as quickly as possible from the very cold condition, i.e. the so called stone cold condition, to a warmth condition at which the temperature of the cooling fluid which is being expelled from the cylinder head outlet 8 of the head cooling jacket 4 thereof is greater than a certain predetermined head temperature, which however will be typically somewhat lower than the abovementioned predetermined temperature for the cooling fluid which is being expelled from the cylinder block outlet 9 of the block cooling jacket 5 of the cylinder block 3, in the first above described method of operation of the first preferred embodiment of the cooling system according to the present invention described above. Typically, this predetermined head cooling fluid temperature may be 80° C., which is sufficient to provide a good intake mixture vaporization effect. Until the controller 26 detects that the temperature of the cooling fluid which is being expelled from the head cooling jacket 4 of the cylinder head 2 through the cylinder head outlet 8 thereof, as measured by the head output fluid temperature sensor 24, is greater than this predetermined head cooling fluid temperature, therefore, the cooling system for the cylinder head 2 is kept completely separate from the cooling system for the cylinder block 3, and no cooling for either is provided via the cooling radiator 17. In this operational condition, the cylinder head 2 retains all the heat which is being generated therein by combustion of fuel in the combustion chambers of the internal combustion engine 1, and is accordingly heated up at the maximum possible rate. After this first phase of maximum head heating operation, however, then the presently described third system of operation of the first preferred embodiment of the cooling system according to the present invention described above may revert, either to a conventional method for cooling of the internal combustion engine 1, wherein the flows of cooling fluid from the cylinder head 2 and from the cylinder block 3 are mixed at all times, or to a method of operation the same as the first above described method of cooling performed by the first preferred embodiment of the cooling system according to the present invention, and described above; or to a method of operation the same as the second above described method of cooling performed by this first embodiment.

In more detail, according to this third method of cooling according to the present invention, while the temperature of the cooling fluid which is being expelled from the head cooling jacket 4 of the cylinder head 2 through the cylinder head outlet 8 thereof, as detected by the head output fluid temperature sensor 24, is less than the above defined predetermined head cooling fluid temperature, i.e. is less than 80° C., then the controller 26 sends a valve control signal to the radiator flow regulation valve 15 which causes said radiator flow regulation valve 15 to be completely closed, so as completely to interrupt transfer of cooling fluid from the downstream end of the main recirculation conduit 14 to the radiator input conduit 16 so as to pass to the cooling radiator 17, and also the controller 26 sends a valve control signal to the block transfer flow regulation valve 22 which causes the block transfer flow regulation valve 22 also to be completely closed, thus completely interrupting flow of cooling fluid from the radiator bypass conduit 21 to the upstream end of the block input conduit 19 and thence to the inlet of the cylinder block pump 11. Accordingly, in this operational condition, no substantial mixing occurs of the flow of cooling fluid which is being expelled from the head cooling jacket 4 through the cylinder head outlet 8 and along the head output conduit 12, and the flow of cooling fluid which is being expelled from the block cooling jacket 5 through the cylinder block outlet 9 and along the block output conduit 13, because the block transfer flow regulation valve 22 is completely closed, and the above described cooling fluid which is being expelled from the head cooling jacket 4 through the cylinder head outlet 8 and along the head output conduit 12 is completely and uniquely recirculated through the main recirculation conduit 14, through the radiator bypass conduit 21, and through the head input conduit 18 to be supplied to the inlet of the cylinder head pump 10, which pumps said cooling fluid back through the cylinder head inlet 6 into the head cooling jacket 4 of the cylinder head 2, while, on the other hand, the cooling fluid which is being expelled from the block cooling jacket 5 through the cylinder block outlet 9 and along the block output conduit 13 completely and uniquely passes into the upstream end of the block recirculation conduit 23 and is transferred down said block recirculation conduit 23 to the inlet of the cylinder block pump 11, which pumps said cooling fluid through the cylinder block inlet 7 back into the block cooling jacket 5 of the cylinder block 3. These two flows of cooling fluid occur substantially independently, since very little mixing thereof can occur at the downstream ends of the head output conduit 12 and of the block output conduit 13. Accordingly, the cylinder head 2 is provided with no substantial cooling effect whatsoever, since the cooling radiator 17 is not being used at this time, and since the flow of cooling fluid through the head cooling jacket 4 of the cylinder head 2 is not being mixed with any other cooler cooling fluid such as the cooling fluid within the block cooling jacket 5 of the cylinder block 3. Accordingly the cylinder head 2 is warmed up at the maximum possible warming up speed, because said cylinder head 2 is retaining all of the heat which is being transferred thereto and which is being generated by combustion of fuel in the combustion chambers of the internal combustion engine 1. At this time, of course, the cylinder block 3 and the lubricating oil contained within said cylinder block 3 are being warmed up at a rather slow warming up rate, as compared with the first above described method of cooling performed by the first preferred embodiment of the cooling system according to the present invention, but this may be tolerated in certain conditions, in view of the desirability of obtaining a good intake mixture vaporization effect.

However, once the sensed temperature signal produced by the head output fluid temperature sensor 24, indicative of the temperature of the cooling fluid which is being expelled from the head cooling jacket 4 through the cylinder head outlet 8, indicates a cooling fluid temperature which is greater than the above described predetermined head cooling fluid temperature, i.e. in this case greater than 80° C., then this operational mode is no longer practiced, and, as described above, either it is possible for the third method of cooling according to the present invention performed by the first preferred embodiment of the cooling system according to the present invention to revert to a form of cooling operation for cooling the internal combustion engine 1 which is purely conventional, in which the radiator flow regulation valve 15 and the block transfer flow regulation valve 22 are kept completely open at all times, so that the flows of cooling fluid through the head cooling jacket 4 of the cylinder head 2 and through the block cooling jacket 5 of the cylinder block 3 are always mixed; or, as an alternative, it is possible for the third method of cooling according to the present invention performed by this first preferred embodiment to revert to a method of cooling operation such as the first above described method of cooling according to the present invention, in which, while the sensed temperature signal sent to the controller 26 by the block output fluid temperature sensor 25 and representative of the temperature of the cooling fluid which is being expelled from the block cooling jacket 5 of the cylinder block 3 through the cylinder block outlet 9 is less than the above described predetermined block cooling fluid temperature, then the radiator flow regulation valve 15 is kept closed, so that no cooling is provided for the internal combustion engine 1 as a whole by the cooling system, and the cooling radiator 17 is not used, while the block transfer flow regulation valve 22 is fully opened, so that the flow of cooling fluid which is passing through the head cooling jacket 4 of the cylinder head 2 is substantially mixed with the flow of cooling fluid which is passing through the block cooling jacket 5 of the cylinder block 3, both of these being recirculated through the main recirculation conduit 14, and in this case the cylinder head 2 and the cylinder block 3 are rapidly brought to substantially the same temperature, and are thencefrom warmed up substantially together, as described above with regard to the first above described method of cooling; or, as a third alternative, after the temperature of the cooling fluid which is being expelled from the head cooling jacket 4 of the cylinder head 2, as detected by the head output fluid temperature sensor 24, has become greater than the above described predetermined head cooling fluid temperature, then it is possible, according to this third method of operation of the first preferred embodiment of the cooling system according to the present invention, for the second above described method of operation of the first preferred embodiment to be practiced, in which even after the internal combustion engine 1 is fully warmed up, the cylinder head 2 thereof is not allowed to become cooler than a certain predetermined operating cooling fluid temperature, for example 30° C. Any one of these three alternatives may be beneficial, depending upon circumstances. The essence of this third method of cooling according to the present invention performed by the first preferred embodiment of the cooling system according to the present invention is to be found in the initial warming up stage, wherein, as described above, both the radiator flow regulation valve 15 and also the block transfer flow regulation valve 22 are fully closed, thus allowing the cylinder head 2 to warm up at the maximum possible warming up rate, in view of maximizing the intake mixture vaporization effect.

Figure 2:
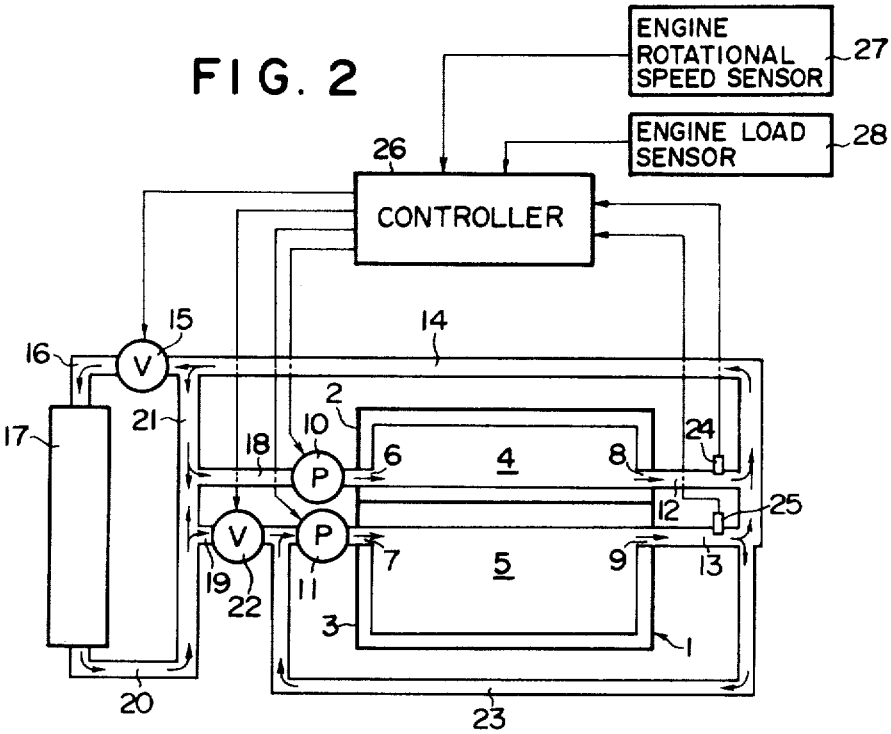
FIG. 2 is a diagrammatical illustration, showing a second preferred embodiment of the cooling system according to the present invention, in which, additionally, the controller is provided with signals representative of engine rotational speed and engine load, from two appropriate sensors.

In FIG. 2, there is shown in a schematic view by a diagrammatical drawing a second preferred embodiment of the cooling system according to the present invention, which practices another preferred embodiment of the method for cooling according to the present invention. In FIG. 2, parts which correspond to parts of the first preferred embodiment of the cooling system according to the present invention shown in FIG. 1, and which have the same functions, are designated by the same reference numerals as in that figure.

The only way in which the structure of this second preferred embodiment of the cooling system according to the present invention differs from the first embodiment shown in FIG. 1 is that, in addition to the signals from the head output fluid temperature sensor 24 and from the block output fluid temperature sensor 25 which are supplied to the controller 26, the controller 26 is also provided with a signal from an engine rotational speed sensor 27, representative of the engine rotational speed, and with a signal from an engine load sensor 28, representative of the engine load.

The method of functioning, according to the present invention, of this second preferred embodiment of the cooling system according to the present invention is as follows.

The basic functioning of this second preferred embodiment is similar to the functioning of the first preferred embodiment of the cooling system according to the present invention shown in FIG. 1. However, in this second preferred embodiment, the controller 26 is able to determine the operational conditions of the internal combustion engine 1, from the engine rotational speed signal produced by the engine rotational speed sensor 27 and from the engine load signal produced by the engine load sensor 28. Accordingly, in this second preferred embodiment, the controller 26 produces a valve control signal for the radiator flow regulation valve 15, and a valve control signal for the block transfer flow regulation valve 22, which control the radiator flow regulation valve 15 and the block transfer flow regulation valve 22 so as to set the temperature of the cooling fluid, both in the cylinder head 2 and in the cylinder block 3, to optimum values with respect to the current operating conditions of the internal combustion engine 1, so as, for example, gradually to lower the temperature of the cylinder head 2 as the engine load increases.

Further, for example, as a particular possibility for this, since actually the occurrence of knocking or pinking is only likely in the high engine load operating condition, therefore at times of other engine operational conditions it is considered to be desirable for the cylinder head 2 to be warmed up to a certain extent, for example to 30° C., in order to minimize the amount of hydrocarbons emitted in the exhaust gases of the internal combustion engine 1. Thus the controller 26, at times of engine operational conditions other than the high engine revolution speed high engine load operational condition, produces control signals for the radiator flow regulation valve 15 which cause said valve 15 to be partially but not completely closed, and hence passage of cooling fluid from the main recirculation conduit 14 to the radiator input conduit 16 and thence to the cooling radiator 17 is somewhat throttled, so as to diminish the amount of cooling provided for the cylinder head 2 by the radiator 17, thereby causing the cylinder head 2 to be warmed up; and this throttling down of the radiator flow regulation valve 15 may be performed in a feedback manner, depending upon the sensed temperature signal received by the controller 26 from the head output fluid temperature sensor 24, in a way which will be clear to one skilled in the control art, based upon the foregoing explanation. On the other hand, in the high engine load operational condition of the internal combustion engine 1, then the radiator flow regulation valve 15 is opened up completely, so as to provide cooling for the cylinder head 2 in the maximum possible amount by completely dethrottling passage of cooling fluid from the main recirculation conduit 14 to the radiator 17, and so as to cool the cylinder head 2 down as much as possible, well below the above mentioned exemplary temperature of 30° C., in order positively to guard against the possibility of knocking or pinking at this time, at which the internal combustion engine 1 is particularly prone to such knocking or pinking.

Further, in this second preferred embodiment, during the warmed up engine condition, i.e. during the condition in which the sensed temperature signal produced by the block output fluid temperature sensor 25 indicates a temperature at the cylinder block outlet 9 of the block cooling jacket 5 of greater than the above mentioned predetermined value, then the controller 26 produces a control signal for controlling the rotational speed of the cylinder head pump 10 so that the difference between the temperature at the cylinder head outlet 8 of the head cooling jacket 4 and the temperature at the cylinder head inlet 6 thereof is kept within a certain limit, for example 10° C. This is possible even though there is no direct sensor, in the second preferred embodiment of the cooling system according to the present invention shown in FIG. 2, for determining the input cooling fluid temperature at the cylinder head inlet 6 of the head cooling jacket 4, because, since the engine operational conditions may be determined by the controller 26 from the output of the engine rotational speed sensor 27 and the output of the engine load sensor 28, thereby it is possible for the controller 26 to calculate with reasonable accuracy the amount of heat, i.e. the calories of heat per minute, which is being generated within the combustion chambers of the internal combustion engine 1 and is being communicated to the cylinder head 2 thereof, by a process of calculation based upon experiment.

Similarly, in this second preferred embodiment of the cooling system according to the present invention, during the warmed up engine condition, i.e. the condition in which the sensed temperature signal produced by the block output fluid temperature sensor 25 indicates a temperature at the cylinder block outlet 9 of the block cooling jacket 5 of greater than the above mentioned predetermined value, then the controller 26 produces a control signal for controlling the rotational speed of the cylinder block pump 11 so that the difference between the temperature at the cylinder block outlet 9 of the block cooling jacket 5 and the temperature at the cylinder block inlet 7 thereof is kept within a certain limit, for example, again, 10° C. Again, this is possible even though there is no direct sensor, in the second preferred embodiment of the cooling system according to the present invention shown in FIG. 2, for determining the input cooling fluid temperature at the cylinder block inlet 7 of the block cooling jacket 5, because, since the engine operational conditions may be determined from the output of the engine rotational speed sensor 27 and the output of the engine load sensor 28, thereby it is possible for the controller 26 to calculate with reasonable accuracy the amount of heat, i.e. the calories of heat per minute, which is being generated within the combustion chambers of the internal combustion engine 1 and is being communicated to the cylinder block 3 thereof, by an analogous procedure of calculation based upon experiment, as was the case for the determination of the amount of heat received by the cylinder head 2, mentioned above.

Accordingly, it is seen that in this second preferred embodiment of the cooling system according to the present invention effectively the same function and advantages are attained, as in the first preferred embodiment of the cooling system according to the present invention described above and shown in FIG. 1. Further, in this second preferred embodiment, hydrocarbon emission in the exhaust gases of the internal combustion engine 1 may be minimized, without thereby substantially making any sacrifice with regard to the anti knocking effect of the present invention, due to the provision of the engine rotational speed sensor 27 and of the engine load sensor 28. Also, because the temperature gradients along the cylinder head 2 and along the cylinder block 3 are reduced, by the above described method of operation of the cylinder head pump 10 and of the cylinder block pump 11, thereby thermal shock caused to the cylinder head 2 and to the cylinder block 3 may be reduced, and a particular risk of warping of the cylinder head 2, which is quite a dangerous possibility when said cylinder head 2 is subjected to undue heat gradients, is reduced.

Figure 3:
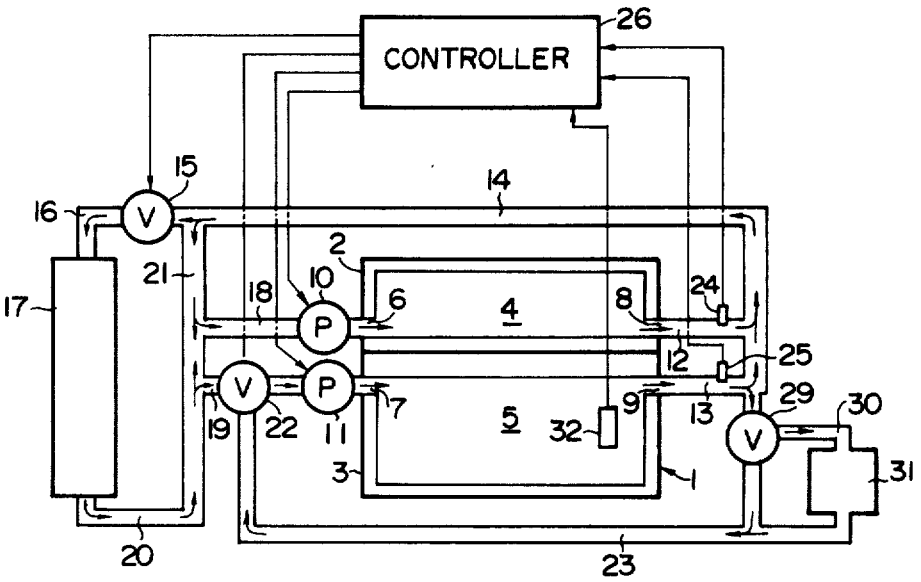
FIG. 3 is a diagrammatical illustration, showing a third preferred embodiment of the cooling system according to the present invention, in which a heater is provided which is heated by fluid in the block recirculation conduit, and in which the second regulation valve is formed as a three way valve.

In FIG. 3, there is shown in a schematic view by a diagrammatical drawing a third preferred embodiment of the cooling system according to the present invention, which practices another preferred embodiment of the method for cooling according to the present invention. In FIG. 3, parts which correspond to parts of the first and second preferred embodiments of the cooling system according to the present invention shown in FIGS. 1 and 2, and which have the same functions, are designated by the same reference numerals as in those figures.

This third preferred embodiment of the cooling system according to the present invention differs from the first preferred embodiment of the cooling system according to the present invention shown in FIG. 1, only in that a heater 31 is provided to the cooling system, in that the block transfer flow regulation valve 22 is constructed as a three way valve, and in that a lubricating oil temperature sensor 32 is provided to sense the temperature of the lubricating oil contained within the cylinder block 3.

In more detail, the block transfer flow regulation valve 22 is constructed as a three way valve which is capable of varying the ratio between the flow rate of the cooling fluid which passes from the radiator output conduit 20 to the inlet of the cylinder block pump 11, and the flow rate of the cooling fluid which passes from the downstream end of the block recirculation conduit 23 to the inlet of the cylinder block pump 11. This is in contrast to the preceding two preferred embodiments of the cooling system according to the present invention, in which the block transfer flow regulation valve 22 could only control the flow rate from the radiator output conduit 20 to the inlet of the cylinder block pump 11, and the corresponding value of the flow rate through the block recirculation conduit 23 to the inlet side of the cylinder block pump 11 was allowed to be set by the natural flow of the system, under the influence of the relatively high flow resistance of the block recirculation conduit 23.

Also, the above mentioned heater 31 is fed with part of the cooling fluid flow which is available in the block recirculation conduit 23, via a three way heater flow diversion valve 29, in a selective manner.

Further, the lubricating oil temperature sensor 32 which is provided to the cylinder block 3 detects the temperature of the lubricating oil contained within the cylinder block 3, and produces a lubricating oil temperature signal representative thereof.

The method of functioning of this third preferred embodiment of the cooling system according to the present invention is similar to that of the first preferred embodiment of the cooling system according to the present invention shown in FIG. 1, except in the following ways.

The transition from the first above described operational condition for the internal combustion engine 1, in which the radiator flow regulation valve 15 is supplied with a valve operating signal from the controller 26 which keeps said radiator flow regulation valve 15 completely closed, thereby ensuring that there is no flow of cooling fluid through the radiator flow regulation valve 15 to the radiator input conduit 16 and the cooling radiator 17, the thereby ensuring that the radiator 17 does not provide any cooling function for the internal combustion engine 1 as a whole, to the second above described operational condition for the internal combustion engine 1, in which the radiator flow regulation valve 15 is completely opened so as to allow cooling fluid to pass substantially freely past the radiator flow regulation valve 15 to be cooled in the radiator 17, does not take place directly, but instead takes place via a third or transitional operational condition, which may persist for some time.

In more detail, in the first operational condition, when the sensed temperature signal from the block output fluid temperature sensor 25 indicates a cooling fluid temperature at the cylinder block outlet 9 of the block cooling jacket 5 which is less than said predetermined temperature of for example 90° C., then the operation according to the present invention of this third preferred embodiment of the cooling system according to the present invention is the same as that of the first preferred embodiment of the cooling system according to the present invention shown in FIG. 1 and described above: the radiator flow regulation valve 15 is kept completely closed, by being fed with an appropriate valve control signal from the controller 26; the block transfer flow regulation valve 22 is kept completely open for the conduit 19, by being fed with an appropriate valve control signal, also, by the controller 26; the cylinder head pump 10 is rotated at a fairly low rotational speed which provides a fairly low delivery rate of cooling fluid to the cylinder head inlet 6 of the cylinder head 2; and the cylinder block pump 11 is rotated at a rotational speed which provides a delivery rate of cooling fluid to the cylinder block inlet 7 which is just sufficient to keep the temperature at the cylinder block outlet 9 of the block cooling jacket 5, as sensed by the block output fluid temperature sensor 25, within the aforementioned small temperature range of the temperature at the cylinder head outlet 8 of the head cooling jacket 4, by a feedback action performed by the controller 26. On the other hand, when the temperature, as sensed by the block output fluid temperature sensor 25, of the cooling fluid which is being expelled from the cylinder head outlet 8, attains the predetermined temperature, in this example 90° C., then it is presumed, according to the functioning of this third preferred embodiment, that the lubricating oil in the cylinder block 3 will not yet have attained a certain predetermined lubricating oil temperature, for example in this case 85° C., and in this case the cooling system according to this third preferred embodiment of the cooling system according to the present invention goes into its third or transitional mode of operation.

In this third or transitional mode of operation, the block transfer flow regulation valve 22 is kept wide open, and the cylinder block pump 11 continues to be rotated at a rotational speed which provides a just sufficient delivery of cooling fluid to the cylinder block inlet 7 of the block cooling jacket 5 for the cooling fluid temperature at the cylinder block outlet 9 thereof to be kept within the aforesaid certain small range of the temperature of the cooling fluid at the cylinder head outlet 8. However, in this third or transitional operational condition, the radiator flow regulation valve 15 is at first gradually opened by just a small amount, by an appropriate valve control signal which is sent thereto by the controller 26, and the amount of opening of the radiator flow regulation valve 15 is then regulated, in a feedback manner which will be easily conceived of by one skilled in the control art, based upon the present disclosure, so as to keep both the temperature of the cooling fluid leaving the head cooling jacket 4 via the cylinder head outlet 8 as sensed by the head output fluid temperature sensor 24, and also the temperature of the cooling fluid leaving the block cooling jacket 5 via the cylinder block outlet 9 as sensed by the block output fluid temperature sensor 25, at substantially the predetermined temperature valve of 90° C. In other words, some cooling fluid flow is allowed into the cooling radiator 17, but not very much. According to this mode of operation, the lubricating oil within the cylinder block 3 of the internal combustion engine 1 continues steadily to rise in temperature. If, on the other hand, the radiator flow regulation valve 15 were to be opened fully as soon as the temperature at the block output fluid temperature sensor 25 became equal to the predetermined temperature of 90° C., then the sudden rush of the cold cooling fluid contained in the radiator input conduit 16, the radiator 17, and the radiator output conduit 20, might well cause the temperature of the cooling fluid in the head cooling jacket 4 of the cylinder head 2 to lower abruptly.

Now the temperature of the lubricating oil within the cylinder block 3 is mostly affected by the temperature of the cylinder block 3 and by the mechanical energy dissipated to this lubricating oil by action of mechanical parts which are lubricated thereby, such as the crankshaft and camshaft of the internal combustion engine 1, etc., but also the temperature of the cylinder head 2 affects the temperature of the lubricating oil within the cylinder block 3 to a certain extent; for example, some of this lubricating oil is typically pumped up to lubricate valve gear and the like mounted to the cylinder head 2, and then is returned to within the cylinder block 3. Accordingly, the above described possibility of sudden drop in the temperature of the cylinder head 2 means that steady temperature rise of the lubricating oil would be disturbed, and that there might even be a risk of sudden drop in the temperature of the lubricating oil within the cylinder block 3, and it is in order to minimize this possibility that this third or transitional operation condition is provided, wherein both the cylinder head 2 and also the cylinder block 3 are maintained at substantially the predetermined temperature, in this case 90° C. It is of course very undersirable for the lubricating oil within the cylinder block 3 actually to drop in temperature at any time, since, as explained above, it is an objective of engine design to warm up this oil as quickly as possible.

On the other hand, when the temperature of the lubricating oil in the cylinder block 3 reaches the above mentioned predetermined lubricating oil temperature, i.e. in this case 85° C., then the operation of this third preferred embodiment of the cooling system according to the present invention is to transit from its third operational condition to its second operational condition, which will now be described. In this condition, the radiator flow regulation valve 15 is fully opened, by provision of appropriate valve control signals thereto by the controller 26, so as to cool the cylinder head 2 as much as possible in order to prevent knocking, and the cylinder head pump 10 is speeded up with regard to its rotational speed, so as to deliver an appropriate amount of cooling fluid to the head cooling jacket 4 for cooling the cylinder head 2. Further, the rotational speed of the cylinder block pump 11 is increased to a fairly high value, for example 20 liters per minute. However, the control of the block transfer flow regulation valve 22, via the valve control signal fed thereto by the controller 26, is not the same in this third preferred embodiment of the cooling system according to the present invention as in the first embodiment shown in FIG. 1. Instead of regulating the temperature at the cylinder block outlet 9 of the block cooling jacket 5 as detected by the block output fluid temperature sensor 25 to the above mentioned predetermined temperature, in this case 90° C., instead in this third preferred embodiment of the cooling system according to the present invention the controller 26 regulates the operation of the block transfer flow regulation valve 22 so as to keep the temperature of the lubricating oil within the cylinder block 3 approximately at a second predetermined lubricating oil temperature value, which should be quite a high temperature value, such as for example 120° C. The feedback system by which the controller 26 so regulates the operation of the block transfer flow regulation valve 22, according to the signal provided by the lubricating oil temperature sensor 32, is similar to that practiced in the second operational condition of the operation of the first preferred embodiment of the cooling system according to the present invention shown in FIG. 1 and described above, and will easily be conceived of by one skilled in the art, based upon the above description.

The reason for making the block transfer flow regulation valve 22 as a three way valve is in order to improve the efficiency of the cooling system according to this third embodiment of the present invention, when warming up the internal combustion engine 1. When the block transfer flow regulation valve 22 is completely opened to allow free flow through the block input conduit 19, i.e. in the first operational condition of this third preferred embodiment of the cooling system according to the present invention as described above, then the block recirculation conduit 23 is completely interrupted thereby, and accordingly mixing of the cooling fluid which has passed through the head cooling jacket 4 in the cylinder head 2, and of the cooling fluid which has passed through the block cooling jacket 5 in the cylinder block 3, is improved, because no recirculation of cylinder block cooling fluid direct to the cylinder block 3 through the block recirculation conduit 23 can occur. Thereby, the warming up time for the internal combustion engine 1 is improved, and, particularly, the efficiency of utilization of the energy for powering the cylinder block pump 11 is improved.

Further, with regard to the matter of the heater fitted in the automobile passenger compartment, when this is fitted, as shown in FIG. 3 and as is customary, at an intermediate part of the block recirculation conduit 23, so as to use cooling fluid from the cylinder block 3 for heating the heater core 31, then a better heating effect is made available, because the cooling fluid of the cylinder block 3 is generally hotter than is the cooling fluid of the cylinder head 2. However, in order to improve heater efficiency and quickness of deployment, when starting up the internal combustion engine 1 from the cold condition, it may be contemplated to allow a certain measure of recirculation of block cooling fluid through the block recirculation conduit 23 and past the block transfer flow regulation valve 22, even in the first above described operational condition of the internal combustion engine 1. According to this alternative construction, in fact, the flow of cooling fluid from the block recirculation conduit 23 to the inlet of the cylinder block pump 11 is never completely cut off, in any operational condition.

Thus, it is seen that, in this third preferred embodiment of the cooling system according to the present invention also, the various advantages and benefits of the present invention are available. The occurence of knocking in the cylinders of the internal combustion engine 1 is guarded against by keeping the cylinder head 2 cool, and at the same time the cylinder block 3 is kept warmer than in the prior art wherein the block cooling fluid flow and the head cooling fluid were mixed at all times. Further, the warming up time for the internal combustion engine 1 is kept minimal, and hence wear thereof during warming up, and consumption of fuel during this warm up period, are minimized.

Figure 4:
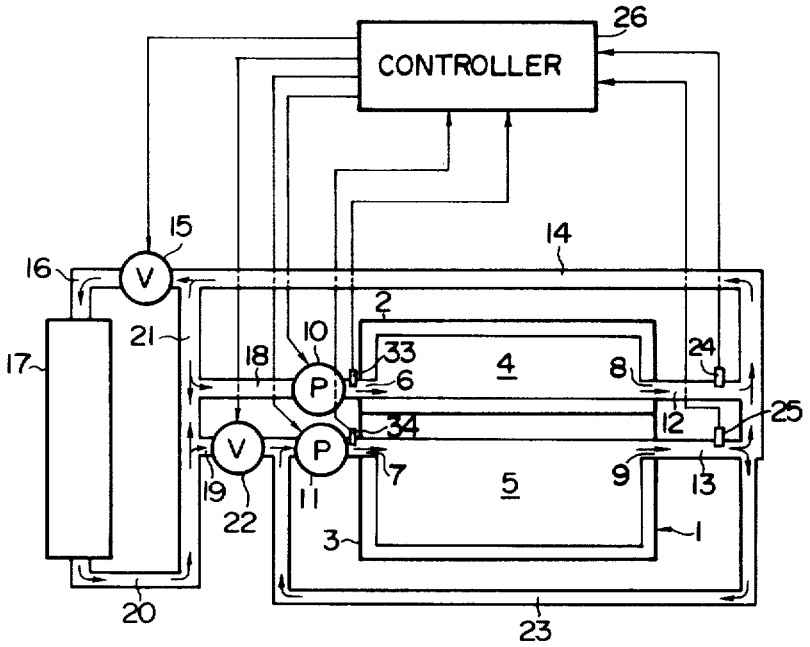
FIG. 4 is a diagrammatical illustration, showing a fourth preferred embodiment of the cooling system according to the present invention, in which temperature sensors are also provided for sensing the temperatures of the cooling fluid which is entering into the cylinder head cooling jacket and of the cooling fluid which is entering into the cylinder block cooling jacket.

In FIG. 4, there is shown in a schematic view by a diagrammatical drawing a fourth preferred embodiment of the cooling system according to the present invention, which practices another preferred embodiment of the method for cooling according to the present invention. In FIG. 4, parts which correspond to parts of the first through third preferred embodiments of the cooling system according to the present invention shown in FIGS. 1-3, and which have the same functions, are designated by the same reference numerals as in those figures.

This fourth preferred embodiment of the cooling system according to the present invention differs from the first preferred embodiment of the cooling system according to the present invention shown in FIG. 1, only in that, in addition to the head output fluid temperature sensor 24 and the block output fluid temperature sensor 25 which sense the temperatures of the flows of cooling fluid which respectively, are passing out through the cylinder head outlet 8 and are passing out through the cylinder block outlet 9, there are provided a head input fluid temperature sensor 33, which detects the temperature of the cooling fluid which is passing in through the cylinder head inlet 6 and which produces a sensed temperature signal representative thereof and supplies said sensed temperature signal to the controller 26, and a block input fluid temperature sensor 34, which senses the temperature of the cooling fluid which is passing in through the cylinder block inlet 7 and which produces another sensed temperature signal representative thereof, said other sensed temperature signal being also supplied to the controller 26.

The method of functioning, according to the present invention, of this fourth preferred embodiment of the cooling system according to the present invention is as follows.

Since the gross structure of this fourth preferred embodiment of the cooling system according to the present invention is the same as that of the first preferred embodiment of the cooling system according to the present invention described above and shown in FIG. 1, except for the additional provision of the head input fluid temperature sensor 33 and of the block input fluid temperature sensor 34, which are mounted respectively in the cylinder head inlet 6 and in the cylinder block inlet 7 in order to sense the temperatures of the flows of cooling fluid which are passing therethrough, reference should be made to the above description of the function of the first preferred embodiment of the cooling system according to the present invention, for a general understanding of the functions of this fourth preferred embodiment.

However, in this fourth preferred embodiment of the cooling system according to the present invention, if at any time during operation of the internal combustion engine 1 it is detected by the controller 26 that the sensed temperature signals output from the head output fluid temperature sensor 24 and from the head input fluid temperature sensor 33 indicate temperature values, respectively at the cylinder head outlet 8 and the cylinder head inlet 6, the difference between which is not within a certain predetermined temperature range, for example 5° C. plus or minus 1° C., then the controller 26 controls the rotational speed of the cylinder head pump 10, either by increasing or decreasing said rotational speed, so as to bring the temperature difference between the temperature at the cylinder head inlet 6 and the temperature at the cylinder head outlet 8 to within that predetermined range; in other words, if the difference between the temperatures at the cylinder head outlet 8 and the cylinder head inlet 6 is greater than the predetermined range (of course the temperature at the cylinder head outlet 8 is always greater than that at the cylinder head inlet 6), then the controller 26 causes the cylinder head pump 10 to rotate faster, so as to provide more cooling for the cylinder head 2 and so as to thereby bring the temperature at the cylinder head outlet 8 down, closer to that at the cylinder head inlet 6, until said temperature at the cylinder head outlet 8 differs from the temperature at the cylinder head inlet 6 by a temperature amount which is within the predetermined range; and if on the other hand the difference between the temperatures at the cylinder head outlet 8 and the cylinder head inlet 6 is less than the predetermined range, then the controller 26 causes the cylinder head pump 10 to rotate slower, so as to allow the cylinder head 2 to be cooled less, and so as accordingly to bring the temperature at the cylinder head outlet 8 up, farther from that at the cylinder head inlet 6, until said temperature at the cylinder head outlet 8 differs from the temperature at the cylinder head inlet 6 by a temperature amount which is within the predetermined range.

Similarly, if at any time during the operation of the internal combustion engine 1 it is detected by the controller 26 that the sensed temperature signals output from the block output fluid temperature sensor 25 and from the block input fluid temperature sensor 34 indicate temperature values, respectively at the cylinder block inlet 7 and the cylinder block outlet 9, the difference between which is not within another predetermined temperature range, which again may be for example 5° C. plus or minus 1° C., then the controller 26 controls the rotational speed of the cylinder block pump 11, either by increasing or decreasing said rotational speed, so as to bring the temperature difference between the temperature at the cylinder block inlet 7 and the temperature at the cylinder block outlet 9 to within that predetermined range; in other words, if the difference between the temperatures at the cylinder block outlet 9 and the cylinder block inlet 7 is greater than the predetermined range (of course the temperature at the cylinder block outlet 9 is always greater than the temperature at the cylinder block inlet 7), then the controller 26 causes the cylinder block pump 11 to rotate faster, so as to provide more cooling effect for the cylinder block 3, and so as to thereby bring the temperature at the cylinder block outlet 9 down, closer to that at the cylinder block inlet 7, until said temperature at the cylinder block outlet 9 differs from the temperature at the cylinder block inlet 7 by a temperature amount within the predetermined range; and if on the other hand the difference between the temperatures at the cylinder block outlet 9 and the cylinder block inlet 7 is less than the predetermined range, then the controller 26 causes the cylinder block pump 11 to rotate slower, so as to allow the cylinder block 3 to be cooled less, and so as accordingly to bring the temperature at the cylinder block outlet 9 up, farther from that at the cylinder block inlet 7, until said temperature at the cylinder block outlet 9 differs from the temperature at the cylinder block inlet 7 by a temperature amount which is within the predetermined range—except that, if the internal combustion engine 1 is operating in the first operational condition detailed above in the description of the functioning of the first preferred embodiment of the cooling system according to the present invention, wherein the radiator flow regulation valve 15 is completely closed and the cooling radiator 17 is not providing any cooling function for the internal combustion engine 1, then the rotational speed of the cylinder block pump 11 must not be lowered so low as to allow the difference between the temperatures at the cylinder block outlet 9 and at the cylinder head outlet 8 to become greater than the above mentioned predetermined small temperature range such as 1° C.; this form of control takes precedence over the present particular control for keeping the temperature difference between the flows of cooling fluid at the cylinder block outlet 9 and the cylinder block inlet 7 at a desirable level.

This system of operation ensures that the temperature gradient across the cylinder head 2, from its left hand side in FIG. 4 to its right hand side, is kept at a desirable value, neither too high nor too low. Further, it is also ensured that the temperature gradient across the cylinder block 3, from its left side in FIG. 4 to its right side, is kept at a desirable value. Thus, it is guaranteed that the temperature gradient along the internal combustion engine 1, both within the cylinder head 2 and within the cylinder block 3 thereof, is kept smooth and within a proper limit. This is important with regard to the warming up process of the internal combustion engine 1, during which, as explained above, there is a danger of a high degree of wear of the internal moving parts thereof, and of high emissions of uncombusted hydrocarbons in the exhaust gases therefrom. This evening of the cooling function within the cylinder head 2 and within the cylinder block 3 is effective for preventing the occurrence of localized hot spots therein, especially during warming up of the internal combustion engine 1. Further, the occurrence of thermal shock to the cylinder head 2, and to the cylinder block 3, is minimized by this construction.

Accordingly, it is clear that the same general advantages and effects are obtained with this fourth preferred embodiment, as with the three other preferred embodiments described earlier; and also that this fourth preferred embodiment of the cooling system according to the present invention has certain advantages and virtues of its own.

Figure 5:
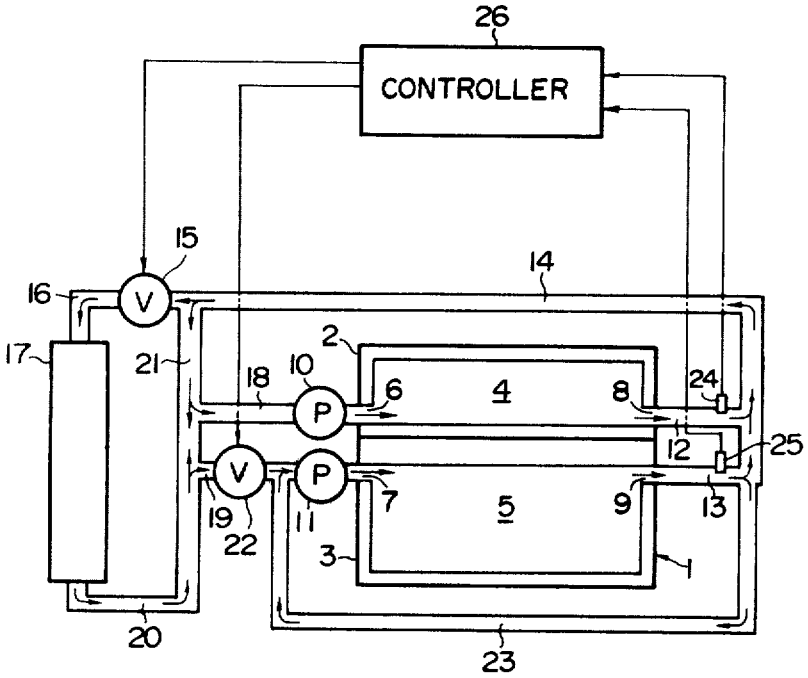
FIG. 5 is a diagrammatical illustration, showing a fifth preferred embodiment of the cooling system according to the present invention, in which the delivery rates of the two pumps which circulate the cooling fluid are not controlled.

In FIG. 5, there is shown in a schematic view by a diagrammatical drawing a fifth preferred embodiment of the cooling system according to the present invention, which practices another preferred embodiment of the method for cooling according to the present invention. In FIG. 5, parts which correspond to parts of the first through fourth preferred embodiments of the cooling system according to the present invention shown in FIGS. 1-4, and which have the same functions, are designated by the same reference numerals as in those figures.

The only difference between this fifth preferred embodiment of the cooling system according to the present invention and the first preferred embodiment of the cooling system according to the present invention shown in FIG. 1 is that in this fifth embodiment the rotational speeds of the cylinder head pump 10 and the cylinder block pump 11 are not controlled by the controller 26, and these cooling fluid pumps are in fact rotated mechanically by the crankshaft (not shown) of the internal combustion engine 1. Accordingly, the delivery rates of the cylinder head pump 10 and of the cylinder block pump 11 are out of the control of the controller 26.

The method of functioning, according to the present invention, of this fifth preferred embodiment of the cooling system according to the present invention is as follows.

Since the gross structure, apart from the controllability of the cylinder head pump 10 and of the cylinder block pump 11, of this fifth preferred embodiment of the cooling system according to the present invention is the same as that of the first preferred embodiment of the cooling system according to the present invention described above and shown in FIG. 1, reference should be made to that description for a general understanding of the functions of this fifth preferred embodiment. The only difference is that no control of the rotational speeds, and of the delivery rates, of the cylinder head pump 10 and of the cylinder block pump 11 is available, in this fifth preferred embodiment of the cooling system according to the present invention, and, accordingly, the rotational speeds of the cylinder head pump 10 and the cylinder block pump 11 must be preset, during the design process of the internal combustion engine 1, to at least the maximum speeds which can be required in any operational conditions of the internal combustion engine 1. Naturally, this will cause a substantial wastage of mechanical energy, and therefore of fuel, during engine operational conditions which do not require such high speeds and delivery rates for the cylinder head pump 10 and the cylinder block pump 11; but this wastage during operation of the fifth preferred embodiment of the cooling system according to the present invention is compensated for by simplicity of design and construction of the cylinder head pump 10 and the cylinder block pump 11, and of the controller 26, and by the increased reliability during operation of this system that is available, by omission of the controlling of the pumps by the controller 26.

In practice, of course, the highest delivery rates required for the cylinder head pump 10 and the cylinder block pump 11 will be during high engine load high engine revolution speed operation of the internal combustion engine 1, i.e. in the second operational condition described above with reference to the first preferred embodiment of the cooling system according to the present invention; and, therefore, during the first operational condition described above, when the radiator flow regulation valve 15 is completely closed and therefore the cooling radiator 17 is not being used for providing any cooling action for the internal combustion engine 1, the recirculating flow of cooling fluid through the main recirculation conduit 14 and the radiator bypass conduit 21 will in fact be much faster than actually necessary, as described above, in order to ensure that the temperature of the cooling fluid at the cylinder head outlet 8 of the head cooling jacket 4 is within the aforesaid small temperature range of the cooling fluid at the cylinder block outlet 9 of the block cooling jacket 5. However, this high rate of recirculation flow is not actually disadvantageous, except for the wastage of mechanical energy, and of fuel, referred to above.

Accordingly, the same beneficial effects and results of the present invention are available in this fifth preferred embodiment of the cooling system according to the present invention also, as in the other preferred embodiments, except for a certain loss of mechanical energy at certain times. In particular, the cylinder head 2 is kept cool during operation of the internal combustion engine 1 after it has been warmed up, and this reduces the possibility of knocking in the combustion chambers of the internal combustion engine 1. Further, the cylinder block 3 is warmed up as quickly as possible, by communicating it with the cylinder head 2 during the warming up process for the internal combustion engine 1, without at that time providing any cooling effect from the cooling radiator 17 to the internal combustion engine 1. Accordingly, the lubricating oil within the cylinder block 3 is also quickly warmed up, and thereby wear on the internal combustion engine 1 during warming up, and emission of harmful hydrocarbons in the exhaust gases thereof at that time, is minimized.

Although the present invention has been shown and described with reference to several preferred embodiments thereof, and in terms of the illustrative drawings, it should not be considered as limited thereby. It should be understood that various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown embodiments, or of the drawings, but solely by the scope of the appended claims, which follow.

I claim:

1. For an internal combustion engine comprising:

(a) a cylinder head formed with a head cooling jacket for cooling said cylinder head, said head cooling jacket being formed with a cylinder head inlet and a cylinder head outlet;

(b) a cylinder block formed with a block cooling jacket for cooling said cylinder block, said block cooling jacket being formed with a cylinder block inlet and a cylinder block outlet; and (c) a radiator formed with an inlet and an outlet;

a cooling system, comprising:

(d) a first pump for impelling cooling fluid through said head cooling jacket from said cylinder head inlet towards said cylinder head outlet;

(e) a second pump for impelling cooling fluid through said block cooling jacket from said cylinder block inlet towards said cylinder block outlet;

(f) a block output fluid temperature sensor for sensing the temperature of the cooling fluid which passes out through said cylinder block outlet of said block cooling jacket, and for generating a sensed block output temperature signal representative of said temperature;

(g) a block recirculation conduit system of relatively high flow resistance, leading from said cylinder block outlet of said block cooling jacket so as to supply flow of cooling fluid to said cylinder block inlet thereof;

(h) a main recirculation conduit system, an upstream part of which is communicated both to said cylinder head outlet of said head cooling jacket and also to said cylinder block outlet of said block cooling jacket, and a downstream part of which is communicated to said inlet of said radiator;

(i) a radiator output conduit system, leading from said outlet of said radiator both to said cylinder head inlet of said head cooling jacket and also to said cylinder block inlet of said block cooling jacket;

(j) a first control valve for controlling flow of cooling fluid through said radiator according to a radiator flow regulation signal;

(k) a radiator bypass conduit system, of relatively high flow resistance, which leads from a downstream part of said main recirculation conduit system both to said cylinder head inlet of said head cooling jacket and also to said cylinder block inlet of said block cooling jacket, operation of said first control valve so as to cut off said flow of cooling fluid through said radiator not cutting off flow of cooling fluid through said radiator bypass conduit system;

(l) a second control valve for controlling flow of cooling fluid from said radiator output conduit system and said radiator bypass conduit system to said cylinder block inlet of said block cooling jacket according to a block flow regulation signal; and (m) a controller, which receives said sensed block output temperature signal from said block output fluid temperature sensor, and which produces, based thereon, said radiator flow regulation signal which is sent to said first control valve, and also said block flow regulation signal which is sent to said second control valve.

2. A cooling system according to claim 1, wherein the flow resistance of said block recirculation conduit system is substantially higher than the flow resistance of the series combination of said main recirculation conduit system from its upstream part which is communicated to said cylinder block outlet of said block cooling jacket to its downstream part from which said radiator bypass conduit system leads, and of said radiator bypass conduit system.

3. A cooling system according to claim 1, wherein said first control valve is mounted between said inlet of said radiator and a part of said main recirculation conduit system which is downstream of the part of said main recirculation system from which said radiator bypass conduit system leads.

4. A cooling system according to claim 1, wherein said second control valve comprises an inlet and an outlet, and wherein said inlet is connected both to a downstream part of said radiator output conduit system and also to a downstream part of said radiator bypass conduit system, and wherein further said outlet of said second control valve leads to said cylinder block inlet of said block cooling jacket.

5. A cooling system according to claim 1, further comprising a head output fluid temperature sensor for sensing the temperature of the cooling fluid which passes out through said cylinder head outlet of said head cooling jacket, and for generating a sensed head output temperature signal representative of said temperature, said sensed head output temperature signal being supplied to said controller.

6. A cooling system according to claim 5, further comprising a head input fluid temperature sensor for sensing the temperature of the cooling fluid which passes in through said cylinder head inlet of said head cooling jacket, and for generating a sensed head input temperature signal representative of said temperature, said sensed head input temperature signal being fed to said controller.

7. A cooling system according to claim 5 wherein said controller simultaneously operates said first pump and said second pump, and, depending on said sensed block output temperature signal from said block output fluid temperature sensor, either (n) if said sensed block output temperature signal from said block output fluid temperature sensor indicates a cooling fluid temperature at said cylinder block outlet of said block cooling jacket of less than a certain first predetermined temperature value, then simultaneously:

(n1) controls said first control valve, by said radiator flow regulation signal, so as substantially to interrupt the flow of cooling fluid through said radiator; and (n2) controls said second control valve, by said block flow regulation signal, so as to allow a flow of cooling fluid through said radiator bypass conduit system from a downstream part of said main recirculation conduit system to said cylinder block inlet of said block cooling jacket; or (o) if said sensed block output temperature signal from said block output fluid temperature sensor indicates a cooling fluid temperature at said cylinder block outlet of said block cooling jacket of greater than said first predetermined temperature value, then simultaneously:

(o1) selectively controls said first control valve, by said radiator flow regulation signal, according to said sensed head output temperature signal received from said head output fluid temperature sensor, so as selectively to allow cooling fluid to flow through said radiator in such a way as to maintain the temperature indicated by said sensed head output temperature signal substantially at a third predetermined temperature value; and (o2) controls said second control valve, by said block flow regulation signal, so as to allow a controlled flow of cooling fluid from said radiator and said radiator output conduit system to said cylinder block inlet of said block cooling jacket.

8. A cooling system according to claim 5, wherein said controller simultaneously operates said first pump and said second pump, and, depending on said sensed head output temperature signal from said head output fluid temperature sensor:

(n) if said sensed head output temperature signal from said head output fluid temperature sensor indicates a cooling fluid temperature at said cylinder head outlet of said head cooling jacket of less than a certain fourth predetermined temperature value, then simultaneously:

(n1) controls said first control valve, by said radiator flow regulation signal, so as substantially to interrupt the flow of cooling fluid through said radiator; and (n2) controls said second control valve, by said block flow regulation signal, so as substantially to interrupt flow of cooling fluid through said radiator bypass conduit system from said main recirculation conduit system to said cylinder block inlet of said block cooling jacket.

9. A cooling system according to claim 8, wherein said conroller, if said sensed head output temperature signal from said head output fluid temperature sensor indicates a cooling fluid temperature at said cylinder head outlet of said head cooling jacket of greater than said fourth predetermined temperature, then, depending on said sensed block output temperature signal from said block output fluid temperature sensor, either (o) if said sensed block output temperature signal from said block output fluid temperature sensor indicates a cooling fluid temperature at said cylinder block outlet of said block cooling jacket of less than a certain fifth predetermined temperature value, then simultaneously:

(o1) controls said first control valve, by said radiator flow regulation signal, so as substantially to interrupt the flow of cooling fluid through said radiator; and (o2) controls said second control valve, by said block flow regulation signal, so as to allow a flow of cooling fluid through said radiator bypass conduit system from a downstream part of said main recirculation conduit system to said cylinder block inlet of said block cooling jacket; or (p) if said sensed block output temperature signal from said block output fluid temperature sensor indicates a cooling fluid temperature at said cylinder block outlet of said block cooling jacket of greater than said fifth predetermined temperature value, then simultaneously:

(p1) controls said first control valve, by said radiator flow regulation signal, so as to allow cooling fluid to flow through said radiator; and (p2) controls said second control valve, by said block flow regulation signal, so as to allow a controlled flow of cooling fluid from said radiator and said radiator output conduit system to said cylinder block inlet of said block cooling jacket.

10. A cooling system according to claim 1, further comprising a block input fluid temperature sensor for sensing the temperature of the cooling fluid which passes in through said cylinder block inlet of said block cooling jacket, and for generating a sensed block input temperature signal representative of said temperature, said sensed block input temperature signal being supplied to said controller.

11. A cooling system according to claim 10, further comprising a head input fluid temperature sensor for sensing the temperature of the cooling fluid which passes in through said cylinder head inlet of said head cooling jacket and for generating a sensed head input temperature signal representative of said temperature, said sensed head input temperature signal being fed to said controller; and also further comprising a head output fluid temperature sensor for sensing the temperature of the cooling fluid which passes out through said cylinder head outlet of said head cooling jacket, and for generating a sensed head output temperature signal representative of said temperature, said sensed head output temperature signal also being supplied to said controller.

12. A cooling system according to claim 1. further comprising an engine rotational speed sensor for detecting the rotational speed of a component of said internal combustion engine and for producing an engine rotational speed sensor signal representative thereof, said engine rotational speed sensor signal being supplied to said controller.

13. A cooling system according to claim 12 further comprising an engine load sensor for detecting the load on said internal combustion engine and for producing an engine load sensor signal representative thereof, said engine load sensor signal being supplied to said conroller.

14. A cooling system according to claim 1, further comprising an engine load sensor for detecting the load on said internal combustion engine and for producing an engine load sensor signal representative thereof, said engine load sensor signal being supplied to said conroller.

15. A cooling system according to claim 14, further comprising a head output fluid temperature sensor for sensing the temperature of the cooling fluid which passes out through said cylinder head outlet of said head cooling jacket, and for generating a sensed head output temperature signal representative of said temperature and feeding said sensed head output temperature signal to said controller, wherein said controller simultaneously operates said first pump and said second pump, and, depending on said sensed block output temperature signal from said block output fluid temperature sensor, either (n) if said sensed block output temperature signal from said block output fluid temperature sensor indicates a cooling fluid temperature at said cylinder block outlet of said block cooling jacket of less than a certain first predetermined temperature value, then simultaneously:

(n1) controls said first control valve, by said radiator flow regulation signal, so as substantially to interrupt the flow of cooling fluid through said radiator; and (n2) controls said second control valve, by said block flow regulation signal, so as to allow a flow of cooling fluid through said radiator bypass conduit system from a downstream part of said main recirculation conduit system to said cylinder block inlet of said block cooling jacket; or (o) if said sensed block output temperature signal from said block output fluid temperature sensor indicates a cooling fluid temperature at said cylinder block outlet of said block cooling jacket of greater than said first predetermined temperature value, then:

(o1) if said engine load sensor is producing an engine load sensor signal indicative of high engine load, then simultaneously:

(p1) controls said first control valve, by said radiator flow regulation signal, so as to allow cooling fluid to flow through said radiator in the maximum amount; and (p2) controls said second control valve, by said block flow regulation signal, so as to allow a controlled flow of cooling fluid from said radiator and said radiator output conduit system to said cylinder block inlet of said block cooling jacket;

(o2) and if said engine load sensor is producing an engine load sensor signal which is not indicative of high engine load, then simultaneously:

(q1) selectively controls said first control valve, by said radiator flow regulation signal, according to said sensed head output temperature signal, so as selectively to allow cooling fluid to flow through said radiator in an amount which is appropriate to maintain the temperature indicated by said sensed head output temperature signal from said head output fluid temperature sensor at approximately a sixth predetermined temperature; and (q2) controls said second control valve, by said block flow regulation signal, so as to allow a controlled flow of cooling fluid from said radiator and said radiator output conduit system to said cylinder block inlet of said block cooling jacket.

16. A cooling system according to claim 15, further comprising an engine rotational speed sensor for detecting the rotational speed of a component of said internal combustion engine and for producing an engine rotational speed sensor signal representative thereof, said engine rotational speed sensor signal being supplied to said controller, wherein said controller, in case (o), controls the delivery rate of said first pump, according to said engine load sensor signal, said engine rotational speed sensor signal, and said sensed head output temperature signal, so as to keep the difference between the cooling fluid temperature at said cylinder head outlet of saidhead cooling jacket and the cooling fluid temperature at said cylinder head inlet of said head cooling jacket below a certain first limit temperature difference.

17. A cooling system according to either one of claims 15 and 16, further comprising an engine rotational speed sensor for detecting the rotational speed of a component of said internal combustion engine and for producing an engine rotational speed sensor signal representative thereof, said engine rotational speed sensor signal being supplied to said controller, wherein said controller, in case (o), controls the delivery rate of said second pump, according to said engine load sensor signal, said engine rotational speed sensor signal, and said sensed block output temperature signal, so as to keep the difference between the cooling flud temperature at said cylinder block output of said block cooling jacket and the cooling fluid temperature at said cylinder block inlet of said block cooling jacket below a certain second limit temperature difference.

18. A cooling system according to claim 1, wherein said controller further controls the delivery rate of said first pump.

19. A cooling system according to claim 1, wherein said controller further controls the delivery rate of said second pump.

20. A cooling system according to claim 1, further comprising an engine lubricating oil temperature sensor for detecting the temperature of lubricating oil contained within said cylinder block, and for producing a lubricating oil temperature signal representative thereof, said lubricating oil temperature signal being supplied to said controller.

21. A cooling system according to claim 20, wherein said controller:

simultaneously operates said first pump and said second pump, and, depending on said sensed block output temperature signal from said block output fluid temperature sensor, either (n) if said sensed block output temperature signal from said ,block output fluid temperature sensor indicates a cooling fluid temperature at said cylinder block outlet of said block cooling jacket of less than a certain first predetermined temperature value, then simultaneously:

(n1) controls said first control valve, by said radiator flow regulation signal, so as substantially to interrupt flow of cooling fluid through said radiator; and (n2) controls said second control valve, by said block flow regulation signal, so as to allow a flow of cooling fluid through said radiator bypass conduit system from a downstream part of said main recirculation conduit system to said cylinder block inlet of said block cooling jacket; or (o) if said sensed block output temperature signal from said block output fluid temperature sensor indicates a cooling fluid temperature at said cylinder block outlet of said block cooling jacket of greater than said first predetermined temperature value, then, depending upon said lubricating oil temperature signal from said engine lubricating oil temperature sensor, either;

(o1) if said lubricating oil temperature signal from said engine lubricating oil temperature sensor indicates an engine lubricating oil temperature of less than a second predetermined temperature value, then simultaneously:

(p1) controls said first control valve, by said radiator flow regulation signal, so as to allow such a flow of cooling fluid through said radiator as to keep the temperature indicated by said sensor block output temperature signal from said block output fluid temperature sensor substantially at said first predetermined temperature value; and (p2) controls said second control valve, by said block flow regulation signal, so as to allow a flow of cooling fluid from a downstream part of said radiator bypass conduit system and from said radiator and said radiator output conduit system to said cylinder block inlet of said block cooling jacket; or (o2) if said lubricating oil temperature signal from said engine lubricating oil temperature sensor indicates an engine lubricating oil temperature of greater than said second predetermined temperature value, then simultaneously:

(q1) controls said first control valve, by said radiator flow regulation signal, so as to allow cooling fluid to flow through said radiator in substantially the maximum amount; and (q2) controls said second control valve, by said block flow regulation signal, so as to allow such a controlled amount of flow of cooling fluid from said radiator and said radiator output conduit system to said cylinder block inlet of said block cooling jacket, as to keep said temperature value indicated by said lubricating oil temperature signal from said engine lubricating oil temperature sensor at substantially a third predetermined temperature value which is substantially higher than said second temperature value.

22. A cooling system according to claim 1, further comprising a heater which is supplied with cooling fluid which is diverted from an intermediate part of said block recirculation conduit system.

23. A cooling system according to claim 16, further comprising a three way valve which performs said diversion of cooling fluid from said intermediate part of said block recirculation conduit system, and which selectively supplies part of said cooling fluid to said heater.

24. A cooling system according to claim 1, wherein said second control valve is formed as a three way valve, comprising two inlets and an outlet, one of said inlets being communicated both to a downstream part of said radiator bypass conduit system and also to a downstream part of said radiator output conduit system, the other of said inlets being communicated to a downstream part of said block recirculation conduit system, and said outlet of said second control valve leading to said cylinder block inlet of said block cooling jacket.

25. A cooling system according to claim 1, wherein said controller simultaneously operates said first pump and said second pump, and, depending on said sensed block output temperature signal from said block output fluid temperature sensor, either (n) if said sensed block output temperature signal from said block output fluid temperature sensor indicates a cooling fluid temperature of said cylinder block outlet of said block cooling jacket of less than a certain first predetermined temperature value, then simultaneously:

(n1) controls said first control valve, by said radiator flow regulation signal, so as substantially to interrupt the flow of cooling fluid through said radiator; and (n2) controls said second control valve, by said block flow regulation signal, so as to allow a flow of cooling fluid through said radiator bypass conduit system from a downstream part of said main recirculation conduit system to said cylinder block inlet of said block cooling jacket;

(o) if said sensed block output temperature signal from said block output fluid temperature sensor indicates a cooling fluid temperature at said cylinder block outlet of said block cooling jacket of greater than said first predetermined temperature value, then simultaneously:

(o1) controls said first control valve, by said radiator flow regulation signal, so as to allow cooling fluid to flow through said radiator; and (o2) controls said second control valve, by said block flow regulation signal, so as to allow a controlled flow of cooling fluid from said radiator and said radiator output conduit system to said cylinder block inlet of said block cooling jacket.

26. A cooling system according to claim 25, wherein in case (n) said controller controls the delivery rate of said first pump to be lower, than said controller controls the delivery rate of said first pump to be in case (o).

27. A cooling system according to claim 25 or 26, further comprising a head output fluid temperature sensor for sensing the temperature of the cooling fluid which passes out from said cylinder head outlet of said head cooling jacket, and for generating a sensed head output temperature signal representative of said temperature, said sensed head output temperature signal being supplied to said controller, wherein in case (n) said controller controls the delivery rate of said second pump to be substantially as low as possible, while keeping the temperature between the temperatures indicated by said sensed head output temperature signal and said sensed block output temperature signal less than a certain predetermined small temperature difference.

28. A cooling system according to claim 27, wherein, if said temperature difference between the temperatures indicated by said sensed head output temperature signal and said sensed block input temperature signal is less than said predetermined small temperature difference, the delivery rate of said pump is decreased, and if said temperature difference is greater than said predetermined small temperature difference, then the delivery rate of said second pump is increased.

29. A cooling system according to claim 25, wherein said controller, in case (o1), always controls said first control valve so as to keep said first control valve fully open.

30. A cooling system according to claim 25, wherein said controller, on transition from case (n) to case (o), controls said first control valve so as to open said first control valve gradually over a certain time period.

31. A cooling system according to claim 30, wherein in case (o), after said time period has elapsed after the transition from case (n) to case (o), said controller always controls said first control valve so as to keep said first control valve fully open.

32. A cooling system according to any one of claims 25, 29, 30, or 31, wherein in case (o) said controller so controls the opening amount of said second valve, by said block flow regulation signal, as to allow such an amount of cooling fluid to flow from said radiator and said radiator output conduit system to said cylinder block inlet of said block cooling jacket, as to keep the sensed block output temperature signal produced by said block output fluid temperature sensor approximately at a level indicative of a second predetermined temperature.

33. A cooling system according to claim 32, wherein said second predetermined temperature is substantially higher than said first predetermined temperature.

34. A cooling system according to claim 33, wherein in case (o), if said temperature indicated by said sensed block output temperature signal is substantially higher than said second predetermined temperature, then said controller controls said second valve so as to open up said second valve wider so as to decrease its flow resistance, and, if said indicated temperature is substantially lower than said second predetermined temperature, said controller controls said second valve so as to make said second valve more closed so as to increase its flow resistance.

35. A cooling system according to claim 25, further comprising a head input fluid temperature sensor for sensing the temperature of the cooling fluid which enters into said cylinder head inlet of said head cooling jacket, and for generating a sensed head input temperature signal representative of said temperature, said sensed head input temperature signal being supplied to said controller, and a head output fluid temperature sensor for sensing the temperature of the cooling fluid which passes out from said cylinder head outlet of said head cooling jacket, and for generating a sensed head output temperature signal representative of said temperature, said sensed head output temperature signal being supplied to said controller; wherein in both cases (n) and (o) said controller so controls the delivery rate of said first pump as to keep the difference between the cooling fluid temperature indicated by said sensed head output temperature signal and the cooling fluid temperature indicated by said sensed head input temperature signal within a certain first range of a certain first predetermined temperature difference.

36. A cooling system according to either one of claims 25 and 26, said cooling system further comprising a block input fluid temperature sensor for sensing the temperature of the cooling fluid which enters into said cylinder block inlet of said block cooling jacket, and for generating a sensed block input temperature signal representative of said temperature, said sensed block input temperature signal being supplied to said controller, wherein in case (o) said controller so controls the delivery rate of said second pump as to keep the difference between the cooling fluid temperature indicated by said sensed block output temperature signal and the cooling fluid temperature indicated by said sensed block input temperature signal within a certain second range of a certain second predetermined temperature difference.

37. A cooling system according to claim 36, wherein in case (n) said controller controls the delivery rate of said second pump so as to keep the difference between the cooling fluid temperature indicated by said sensed block output temperature signal and the cooling fluid temperature indicated by said sensed block input temperature signal less than a third predetermined temperature difference.

38. A cooling system according to claim 35, said cooling system further comprising a block input fluid temperature sensor for sensing the temperature of the cooling fluid which enters into said cylinder block inlet of said block cooling jacket, and for generating a sensed block input temperature signal representative of said temperature, said sensed block input temperature signal being supplied to said controller, wherein in case (n) said controller controls the delivery rate of said second pump to be the larger of:

(p) the delivery rate required to keep the difference between the cooling fluid temperature indicated by said sensed block output temperature signal and the cooling fluid temperature indicated by said sensed block input temperature signal within a certain third range of a certain third predetermined temperature difference; and (g) the delivery rate required to keep the difference between the cooling fluid temperature indicated by said sensed head output temperature signal and the cooling fluid temperature indicated by said sensed block output temperature signal less than a certain fourth small predetermined temperature difference.

39. A method for operating a cooling system for an internal combustion engine, said engine comprising:

(a) a cylinder head formed with a head cooling jacket for cooling said cylinder head, said head cooling jacket being formed with a cylinder head inlet and a cylinder head outlet;

(b) a cylinder block formed with a block cooling jacket for cooling said cylinder block, said block cooling jacket being formed with a cylinder block inlet and a cylinder block outlet; and (c) a radiator formed with an inlet and an outlet; a cooling system comprising:

(d) a first pump for impelling cooling fluid through said head cooling jacket from said cylinder head inlet towards said cylinder head outlet;

(e) a second pump for impelling cooling fluid through said block cooling jacket from said cylinder block inlet towards said cylinder block outlet;

(f) a block output fluid temperature sensor for sensing the temperature of the cooling fluid which passes out through said cylinder block outlet of said block cooling jacket, and for generating a sensed block output temperature signal representative of said temperature;

(g) a block recirculation conduit system of relatively high flow resistance, leading from said cylinder block outlet of said block cooling jacket so as to supply flow of cooling fluid to said cylinder block inlet thereof;

(h) a main recirculation conduit system, an upstream part of which is communicated both to said cylinder head outlet of said head cooling jacket and also to said cylinder block outlet of said block cooling jacket, and a downstream part of which is communicated to said inlet of said radiator;

(i) a radiator output conduit system, leading from said outlet of said radiator both to said cylinder head inlet of said head cooling jacket and also to said cylinder block inlet of said block cooling jacket;

(j) a first control valve for controlling flow of cooling fluid through said radiator according to a radiator flow regulation signal;

(k) a radiator bypass conduit system, of relatively high flow resistance, which leads from a downstream part of said main recirculation conduit system both to said cylinder head inlet of said head cooling jacket and also to said cylinder block inlet of said block cooling jacket, operation of said first control valve so as to cut off said flow of cooling fluid through said radiator not cutting off flow of cooling fluid through said radiator bypass conduit system;

(l) a second control valve for controlling flow of cooling fluid from said radiator output conduit system and said radiator bypass conduit system to said cylinder block inlet of said block cooling jacket according to a block flow regulation signal; and (m) a controller, which receives said sensed block output temperature signal from said block output fluid temperature sensor, and which produces, based thereon, said radiator flow regulation signal which is sent to said first control valve, and also said block flow regulation signal which is sent to said second control valve, when said cooling system is filled with cooling fluid, comprising the processes, simultaneously performed, of:

(n) operating said first pump and said second pump; and (o) depending upon said sensed block output temperature signal from said block output fluid temperature sensor, performing either one or the other but not both of the following two processes (p) and (q):

(p) if said sensed block output temperature signal from said block output fluid temperature sensor indicates a cooling fluid temperature at said cylinder block outlet of said block cooling jacket of less than a certain first predetermined temperature value, then simultaneously:

(p1) controlling said first control valve, by said radiator flow regulation signal from said controller, so as substantially to interrupt flow of cooling fluid through said radiator; and (p2) controlling said second control valve, by said block flow regulation signal, so as to allow a flow of cooling fluid through said radiator bypass conduit system from a downstream part of said main recirculation conduit system to said cylinder block inlet of said block cooling jacket;

(q) if said sensed block output temperature signal from said block output fluid temperature sensor indicates a cooling fluid temperature at said cylinder block outlet of said block cooling jacket of greater than said first predetermined temperature value, then simultaneously:

(q1) controlling said first control valve, by said radiator flow regulation signal from said controller, so as to allow cooling fluid to flow through said radiator; and (q2) controlling said second control valve, by said block flow regulation signal, so as to allow a controlled flow of cooling fluid from said radiator and said radiator output conduit system to said cylinder block inlet of said block cooling jacket.

40. A method for operating according to claim 39, wherein during process (p) the delivery rate of said first pump is controlled to be lower, than the delivery rate of said first pump during process (q).

41. A method for operating according to claim 39 or 40, said cooling system further comprising a head output fluid temperature sensor for sensing the temperature of the cooling fluid which passes out from said cylinder head outlet of said head cooling jacket, and for generating a sensed head output temperature signal representative of said temperature, said sensed head output temperature signal being supplied to said controller, wherein during process (p) the delivery rate of said second pump is so controlled as to be substantially as low as possible, while keeping the temperature difference between the temperatures indicated by said sensed head output temperature signal and said sensed block output temperature signal less than a certain predetermined small temperature difference.

42. A method for operating according to claim 41, wherein, if said temperature difference between the temperatures indicated by said sensed head output temperature signal and said sensed block output temperature signal is substantially less than said predetermined small temperature difference, the delivery rate of said pump is decreased, and if said temperature difference is substantially greater than said predetermined small temperature difference, then the delivery rate of said second pump is increased.

43. A method for operating according to claim 39, wherein during subprocess (q1) said first control valve is always controlled to be fully open.

44. A method for operating according to claim 39, wherein, on transition from process (p) to process (q), said first control valve is so controlled as to open gradually over a certain time period.

45. A method for operating according to claim 44, wherein during process (q), after said time period, said first control valve is always so controlled as to be fully open.

46. A method for operating according to any one of claims 39, 43, 44, or 46, wherein during process (q) the opening amount of said second valve is controlled, by said block flow regulation signal, as to allow such an amount of cooling fluid to flow from said radiator and said radiator output conduit system to said cylinder block inlet of said block cooling jacket, as to keep the sensed block output temperature signal produced by said block output fluid temperature sensor approximately at a level indicative of a second predetermined temperature.

47. A method for operating according to claim 46, wherein said second predetermined temperature is substantially higher than said first predetermined temperature.

48. A method for operating according to claim 47, wherein at some times during process (q) a substantial amount of cooling fluid flows from said cylinder block outlet of said block cooling jacket through said block recirculation conduit system to said cylinder block inlet, while bypassing said radiator.

49. A method for operating according to claim 48, wherein during process (q), if said temperature indicated by said sensed block output temperature signal is substantially higher than said second predetermined temperature, then said second valve is opened up wider so as to decrease its flow resistance, and, if said indicated temperature is substantially less than said second predetermined temperature, then said second valve is further closed so as to increase its flow resistance.

50. A method for operating according to claim 39, said cooling system further comprising a head input fluid temperature sensor for sensing the temperature of the cooling fluid which enters into said cylinder head inlet of said head cooling jacket, and for generating a sensed head input temperature signal representative of said temperature, said sensed head input temperature signal being supplied to said controller, and a head output fluid temperature sensor for sensing the temperature of the cooling fluid which passes out from said cylinder head outlet of said head cooling jacket, and for generating a sensed head output temperature signal representative of said temperature, said sensed head output temperature signal being supplied to said controller; wherein during both processes (p) and (q) the delivery rate of said first pump is so controlled as to keep the difference between the cooling fluid temperature indicated by said sensed head output temperature signal and the cooling fluid temperature indicated by said sensed head input temperature signal within a certain first range of a certain first predetermined temperature difference.

51. A method for operating according to either one of claims 39 and 50, said cooling system further comprising a block input fluid temperature sensor for sensing the temperature of the cooling fluid which enters into said cylinder block inlet of said block cooling jacket, and for generating a sensed block input temperature signal representative of said temperature, said sensed block input temperature signal being supplied to said controller, wherein during process (q) the delivery rate of said second pump is so controlled as to keep the difference between the cooling fluid temperature indicated by said sensed block output temperature signal and the cooling fluid temperature indicated by said sensed block input temperature signal within a certain second range of a certain second predetermined temperature difference.

52. A method for operating according to claim 51, wherein during process (p) the delivery rate of said second pump is so controlled as to keep the difference between the cooling fluid temperature indicated by said sensed block output temperature signal and the cooling fluid temperature indicated by said sensed block input temperature signal less than a third predetermined temperature difference.

53. A method for operating according to claim 50, said cooling system further comprising a block input fluid temperature sensor for sensing the temperature of the cooling fluid which enters into said cylinder block inlet of said block cooling jacket, and for generating a sensed block input temperature signal representative of said temperature, said sensed block input temperature signal being supplied to said controller, wherein during process (p) the delivery rate of said second pump is so controlled as to be the larger of:

(r) the delivery rate required to keep the difference between the cooling fluid temperature indicated by said sensed block output temperature signal and the cooling fluid temperature indicated by said sensed block input temperature signal within a certain third range of a certain third predetermined temperature difference; and (s) the delivery rate required to keep the difference between the cooling fluid temperature indicated by said sensed head output temperature signal and the cooling fluid temperature indicated by said sensed block output temperature signal less than a certain fourth small predetermined temperature difference.

54. A method for operating a cooling system for an internal combustion engine, said engine comprising:

(a) a cylinder head formed with a head cooling jacket for cooling said cylinder head, said head cooling jacket being formed with a cylinder head inlet and a cylinder head outlet;

(b) a cylinder block formed with a block cooling jacket for cooling said cylinder block, said block cooling jacket being formed with a cylinder block inlet and a cylinder block outlet; and (c) a radiator formed with an inlet and an outlet; a cooling system comprising:

(d) a first pump for impelling cooling fluid through said head cooling jacket from said cylinder head inlet towards said cylinder head outlet;

(e) a second pump for impelling cooling fluid through said block cooling jacket from said cylinder block inlet towards said cylinder block outlet;

(f) a block output fluid temperature sensor for sensing the temperature of the cooling fluid which passes out through said cylinder block outlet of said block cooling jacket, and for generating a sensed block output temperature signal representative of said temperature;

(g) a block recirculation conduit system of relatively high flow resistance, leading from said cylinder block outlet of said block cooling jacket so as to supply flow of cooling fluid to said cylinder block inlet thereof;

(h) a main recirculation conduit system, an upstream part of which is communicated both to said cylinder head outlet of said head cooling jacket and also to said cylinder block outlet of said block cooling jacket, and a downstream part of which is communicated to said inlet of said radiator;

(i) a radiator output conduit system, leading from said outlet of said radiator both to said cylinder head inlet of said head cooling jacket and also to said cylinder block inlet of said block cooling jacket;

(j) a first control valve for controlling flow of cooling fluid through said radiator according to a radiator flow regulation signal;

(k) a radiator bypass conduit system, of relatively high flow resistance, which leads from a downstream part of said main recirculation conduit system both to said cylinder head inlet of said head cooling jacket and also to said cylinder block inlet of said block cooling jacket, operation of said first control valve so as to cut off said flow of cooling fluid through said radiator not cutting off flow of cooling fluid through said radiator bypass conduit system;

(l) a second control valve for controlling flow of cooling fluid from said radiator output conduit system and said radiator bypass conduit system to said cylinder block inlet of said block cooling jacket according to a block flow regulation signal; and (m) a controller, which receives said sensed block output temperature signal from said block output fluid temperature sensor, and which produces, based thereon, said radiator flow regulation signal which is sent to said first control valve, and also said block flow regulation signal which is sent to said second control valve and a head output fluid temperature sensor for sensing the temperature of the cooling fluid which passes out through said cylinder head outlet of said head cooling jacket, and for generating a sensed head output temperature signal representative of said temperature, said sensed head output temperature signal being supplied to said controller, when said cooling system is filled with cooling fluid, comprising the processes, simultaneously performed, of:

(n) operating said first pump and said second pump; and (o) depending upon said sensed block output temperature signal from said block output fluid temperature sensor, performing either one or the other but not both of the following two processes (p) and (q);

(p) if said sensed block output temperature signal from said block output fluid temperature sensor indicates a cooling fluid temperature at said cylinder block outlet of said block cooling jacket of less than a certain first predetermined temperature value, then simultaneously:

(p1) controlling said first control valve, by said radiator flow regulation signal from said controller, so as substantially to interrupt flow of cooling fluid through said radiator; and (p2) controlling said second control valve, by said block flow regulation signal, so as to allow a flow of cooling fluid through said radiator bypass conduit system from a downstream part of said main recirculation conduit system to said cylinder block inlet of said block cooling jacket;

(q) if said sensed block output temperature signal from said block output fluid temperature sensor indicates a cooling fluid temperature at said cylinder block outlet of said block cooling jacket of greater than said first predetermined temperature value, then simultaneously:

(q1) selectively controlling said first control valve, by said radiator flow regulation signal from said controller, according to said sensed head output temperature signal received from said head output fluid temperature sensor by said controller, so as selectively to allow cooling fluid to flow through said radiator in such a way as to maintain the temperature indicated by said sensed head output temperature signal substantially at a third predetermined temperature value; and (q2) controlling said second control valve, by said block flow regulation signal, so as to allow a controlled flow of cooling fluid from said radiator and said radiator output conduit system to said cylinder block inlet of said block cooling jacket.

55. A method for operating a cooling system for an internal combustion engine, said engine comprising:

(a) a cylinder head formed with a head cooling jacket for cooling said cylinder head, said head cooling jacket being formed with a cylinder head inlet and a cylinder head outlet;

(b) a cylinder block formed with a block cooling jacket for cooling said cylinder block, said block cooling jacket being formed with a cylinder block inlet and a cylinder block outlet; and (c) a radiator formed with an inlet and an outlet; a cooling system comprising:

(d) a first pump for impelling cooling fluid through said head cooling jacket from said cylinder head inlet towards said cylinder head outlet;

(e) a second pump for impelling cooling fluid through said block cooling jacket from said cylinder block inlet towards said cylinder block outlet;

(f) a block output fluid temperature sensor for sensing the temperature of the cooling fluid which passes out through said cylinder block outlet of said block cooling jacket, and for generating a sensed block output temperature signal representative of said temperature;

(g) a block recirculation conduit system of relatively high flow resistance, leading from said cylinder block outlet of said block cooling jacket so as to supply flow of cooling fluid to said cylinder block inlet thereof;

(h) a main recirculation conduit system, an upstream part of which is communicated both to said cylinder head outlet of said head cooling jacket and also to said cylinder block outlet of said block cooling jacket, and a downstream part of which is communicated to said inlet of said radiator;

(i) a radiator output conduit system, leading from said outlet of said radiator both to said cylinder head inlet of said head cooling jacket and also to said cylinder block inlet of said block cooling jacket;

(j) a first control valve for controlling flow of cooling fluid through said radiator according to a radiator flow regulation signal;

(k) a radiator bypass conduit system, of relatively high flow resistance, which leads from a downstream part of said main recirculation conduit system both to said cylinder head inlet of said head cooling jacket and also to said cylinder block inlet of said block cooling jacket, operation of said first control valve so as to cut off said flow of cooling fluid through said radiator not cutting off flow of cooling fluid through said radiator bypass conduit system;

(l) a second control valve for controlling flow of cooling fluid from said radiator output conduit system and said radiator bypass conduit system to said cylinder block inlet of said block cooling jacket according to a block flow regulation signal; and (m) a controller, which receives said sensed block output temperature signal from said block output fluid temperature sensor, and which produces, based thereon, said radiator flow regulation signal which is sent to said first control valve, and also said block flow regulation signal which is sent to said second control valve and a head output fluid temperature sensor for sensing the temperature of the cooling fluid which passes out through said cylinder head outlet of said head cooling jacket, and for generating a sensed head output temperature signal representative of said temperature, said sensed head output temperature signal being supplied to said controller, when said cooling system is filled with cooling fluid, comprising the processes simultaneously performed, of:

(n) operating said first pump and said second pump; and (o) if said sensed head output temperature signal from said head output fluid temperature sensor indicates a cooling fluid temperature at said cylinder head outlet of said head cooling jacket of less than a certain fourth predetermined temperature value, then simultaneously:

(o1) controlling said first control valve, by said radiator flow regulation signal from said controller, so as substantially to interrupt flow of cooling fluid through said radiator; and (o2) controlling said second control valve, by said block flow regulation signal, so as substantially to interrupt flow of cooling fluid through said radiator bypass conduit system from said main recirculation conduit system to said cylinder block inlet of said block cooling jacket.

56. A method for operating according to claim 55, wherein, if said sensed head output temperature signal from said head output fluid temperature sensor indicates a cooling fluid temperature at said cylinder head outlet of said head cooling jacket of greater than said fourth predetermined temperature, then, depending upon said sensed block output temperature signal from said block output fluid temperature sensor, performing either one or the other but not both of the following two processes (p) and (q):

(p) if said sensed block output temperature signal from said block output fluid temperature sensor indicates a cooling fluid temperature at said cylinder block outlet of said block cooling jacket of less than a certain fifth predetermined temperature value, then simultaneously:

(p1) controlling said first control valve, by said radiator flow regulation signal from said controller, so as substantially to interrupt flow of cooling fluid through said radiator; and (p2) controlling said second control valve, by said block flow regulation signal, so as to allow a flow of cooling fluid through said radiator bypass conduit system from a downstream part of said main recirculation conduit system to said cylinder block inlet of said block cooling jacket;

(q) if said sensed block output temperature signal from said block output fluid temperature sensor indicates a cooling fluid temperature at said cylinder block outlet of said block cooling jacket of greater than said fifth predetermined temperature value, then simultaneously:

(q1) controlling said first control valve, by said radiator flow regulation signal from said controller, so as to allow cooling fluid to flow through said radiator; and (q2) controlling said second control valve, by said block flow regulation signal, so as to allow a controlled flow of cooling fluid from said radiator and said radiator output conduit system to said cylinder block inlet of said block cooling jacket.

57. A method for operating a cooling system for an internal combustion engine, said engine comprising:

(a) a cylinder head formed with a head cooling jacket for cooling said cylinder head, said head cooling jacket being formed with a cylinder head inlet and a cylinder head outlet;

(b) a cylinder block formed with a block cooling jacket for cooling said cylinder block, said block cooling jacket being formed with a cylinder block inlet and a cylinder block outlet; and (c) a radiator formed with an inlet and an outlet; a cooling system comprising:

(d) a first pump for impelling cooling fluid through said head cooling jacket from said cylinder head inlet towards said cylinder head outlet;

(e) a second pump for impelling cooling fluid through said block cooling jacket from said cylinder block inlet towards said cylinder block outlet;

(f) a block output fluid temperature sensor for sensing the temperature of the cooling fluid which passes out through said cylinder block outlet of said block cooling jacket, and for generating a sensed block output temperature signal representative of said temperature;

(g) a block recirculation conduit system of relatively high flow resistance, leading from said cylinder block outlet of said block cooling jacket so as to supply flow of cooling fluid to said cylinder block inlet thereof;

(h) a main recirculation conduit system, an upstream part of which is communicated both to said cylinder head outlet of said head cooling jacket and also to said cylinder block outlet of said block cooling jacket, and a downstream part of which is communicated to said inlet of said radiator;

(i) a radiator output conduit system, leading from said outlet of said radiator both to said cylinder head inlet of said head cooling jacket and also to said cylinder block inlet of said block cooling jacket;

(j) a first control valve for controlling flow of cooling fluid through said radiator according to a radiator flow regulation signal;

(k) a radiator bypass conduit system, of relatively high flow resistance, which leads from a downstream part of said main recirculation conduit system both to said cylinder head inlet of said head cooling jacket and also to said cylinder block inlet of said block cooling jacket, operation of said first control valve so as to cut off said flow of cooling fluid through said radiator not cutting off flow of cooling fluid through said radiator bypass conduit system;

(l) a second control valve for controlling flow of cooling fluid from said radiator output conduit system and said radiator bypass conduit system to said cylinder block inlet of said block cooling jacket according to a block flow regulation signal; and (m) a controller, which receives said sensed block output temperature signal from said block output fluid temperature sensor, and which produces, based thereon, said radiator flow regulation signal which is sent to said first control valve, and also said block flow regulation signal which is sent to said second control valve, (n) an engine rotational speed sensor for detecting the rotational speed of a component of said internal combustion engine and for producing an engine rotational speed sensor signal representative thereof, said engine rotational speed sensor signal being supplied to said controller, and (o) an engine load sensor for detecting the load on said internal combustion engine and for producing an engine load sensor signal representative thereof, said engine load sensor signal being supplied to said controller, said cooling system further comprising a head output fluid temperature sensor for sensing the temperature of the cooling fluid which passes out through said cylinder head outlet of said head cooling jacket, and for generating a sensed head output temperature signal representative of said temperature and feeding said sensed head output temperature signal to said controller, said cooling system being filled with cooling fluid, comprising the processes, simultaneously performed, of:

(p) operating said first pump and said second pump; and (q) depending upon said sensed block output temperature signal from said block output fluid temperature sensor, performing either one or the other but not both of the following two processes (r) and (s):

(r) if said sensed block output temperature signal from said block output fluid temperature sensor indicates a cooling fluid temperature at said cylinder block outlet of said block cooling jacket of less than a certain first predetermined temperature value, then simultaneously:

(r1) controlling said first control valve, by said radiator flow regulation signal from said controller, so as substantially to interrupt flow of cooling fluid through said radiator; and (r2) controlling said second control valve, by said block flow regulation signal, so as to allow a flow of cooling fluid thorugh said radiator bypass conduit system from a downstream part of said main recirculation conduit system to said cylinder block inlet of said block cooling jacket;

(s) if said sensed block output temperature signal from said block output fluid temperature sensor indicates a cooling fluid temperature at said cylinder block outlet of said block cooling jacket of greater than said first predetermined temperature value, then:

(s1) if said engine rotational speed sensor is producing an engine rotational speed sensor signal representative of high engine rotational speed and at the same time said engine load sensor is producing an engine load sensor signal indicative of high engine load, then simultaneously:

(t1) controlling said first control valve, by said radiator flow regulation signal from said controller, so as to allow cooling fluid to flow through said radiator in the maximum amount; and (t2) controlling said second control valve, by said block flow regulation signal, so as to allow a controlled flow of cooling fluid from said radiator and said radiator output conduit system to said cylinder block inlet of said block cooling jacket;

(s2) and if said engine load sensor is producing an engine load sensor signal which is not indicative of high engine load, then simultaneously:

(u1) selectively controlling said first control valve, by said radiator flow regulation signal from said controller, according to said sensed head output temperature signal, so as selectively to allow cooling fluid to flow through said radiator in an amount which is appropriate to maintain the temperature indicated by said sensed head output temperature signal from said head output fluid temperature sensor at approximately a sixth predetermined temperature; and (u2) controlling said second control valve, by said block flow regulation signal, so as to allow a controlled flow of cooling fluid from said radiator and said radiator output conduit system to said cylinder block inlet of said block cooling jacket.

58. A method for operating according to claim 57, said cooling system further comprising an engine rotational speed sensor for detecting the rotational speed of a component of said internal combustion engine and for producing an engine rotational speed sensor signal representative thereof, said engine rotational speed sensor signal being supplied to said controller, further comprising the process, performed simultaneously with process (q), of controlling the delivery rate of said first pump, according to said engine load sensor signal, said engine rotational speed sensor signal, and said sensed head output temperature signal, so as to keep the difference between the cooling fluid temperature at said cylinder head outlet of said head cooling jacket and the cooling fluid temperature at said cylinder head inlet of said head cooling jacket below a certain first limit temperature difference.

59. A method for operating according to either one of claims 57 and 58, said cooling system further comprising an engine rotational speed sensor for detecting the rotational speed of a component of said internal combustion engine and for producing an engine rotational speed sensor signal representative thereof, said engine rotational speed sensor signal being supplied to said controller, further comprising the process, performed simultaneously with process (q), of controlling the delivery rate of said second pump, according to said engine load sensor signal, said engine rotational speed sensor signal, and said sensed block output temperature signal, so as to keep the difference between the cooling fluid temperature at said cylinder block outlet of said block cooling jacket and the cooling fluid temperature at said cylinder block inlet of said block cooling jacket below a certain second limit temperature difference.

60. A method for operating a cooling system for an internal combustion engine, said engine comprising:

(a) a cylinder head formed with a head cooling jacket for cooling said cylinder head, said head cooling jacket being formed with a cylinder head inlet and a cylinder head outlet;

(b) a cylinder block formed with a block cooling jacket for cooling said cylinder block, said block cooling jacket being formed with a cylinder block inlet and a cylinder block outlet; and (c) a radiator formed with an inlet and an outlet; a cooling system comprising:

(d) a first pump for impelling cooling fluid through said head cooling jacket from said cylinder head inlet towards said cylinder head outlet;

(e) a second pump for impelling cooling fluid through said block cooling jacket from said cylinder block inlet towards said cylinder block outlet;

(f) a block output fluid temperature sensor for sensing the temperature of the cooling fluid which passes out through said cylinder block outlet of said block cooling jacket, and for generating a sensed block output temperature signal representative of said temperature;

(g) a block recirculation conduit system of relatively high flow resistance, leading from said cylinder block outlet of said block cooling jacket so as to supply flow of cooling fluid to said cylinder block inlet thereof;

(h) a main recirculation conduit system, an upstream part of which is communicated both to said cylinder head outlet of said head cooling jacket and also to said cylinder block outlet of said block cooling jacket, and a downstream part of which is communicated to said inlet of said radiator;

(i) a radiator output conduit system, leading from said outlet of said radiator both to said cylinder head inlet of said head cooling jacket and also to said cylinder block inlet of said block cooling jacket;

(j) a first control valve for controlling flow of cooling fluid through said radiator according to a radiator flow regulation signal;

(k) a radiator bypass conduit system, of relatively high flow resistance, which leads from a downstream part of said main recirculation conduit system both to said cylinder head inlet of said head cooling jacket and also to said cylinder block inlet of said block cooling jacket, operation of said first control valve so as to cut off said flow of cooling fluid through said radiator not cutting off flow of cooling fluid through said radiator bypass conduit system;

(l) a second control valve for controlling flow of cooling fluid from said radiator output conduit system and said radiator bypass conduit system to said cylinder block inlet of said block cooling jacket according to a block flow regulation signal; and (m) a controller, which receives said sensed block output temperature signal from said block output fluid temperature sensor, and which produces, based thereon, said radiator flow regulation signal which is sent to said first control valve, and also said block flow regulation signal which is sent to said second control valve, and an engine lubricating oil temperature sensor for detecting the temperature of lubricating oil contained within said cylinder block, and for producing a lubricating oil temperature signal representative thereof, said lubricating oil temperature signal being supplied to said controller, when said cooling system is filled with cooling fluid, comprising the processes, simultaneously performed, of:

(n) operating said first pump and said second pump; and (o) depending upon said sensed block output temperature signal from said block output fluid temperature sensor, performing either one or the other but not both of the following two processes (p) and (q);

(p) if said sensed block output temperature signal from said block output fluid temperature sensor indicates a cooling fluid temperature at said cylinder block outlet of said block cooling jacket of less than a certain first predetermined temperature value, then simultaneously:

(p1) controlling said first control valve, by said radiator flow regulation signal from said controller, so as substantially to interrupt flow of cooling fluid through said radiator; and (p2) controlling said second control valve, by said block flow regulation signal, so as to allow a flow of cooling fluid through said radiator bypass conduit system from a downstream part of said main recirculation conduit system to said cylinder block inlet of said block cooling jacket;

(q) if said sensed block output temperature signal from said block output fluid temperature sensor indicates a cooling fluid temperature at said cylinder block outlet of said block cooling jacket of greater than said first predetermined temperature value, then, depending upon said lubricating oil temperature signal from said engine lubricating oil temperature sensor, performing either one or the other but not both of the following two processes (q1) and (q2):

(q1) if said lubricating oil temperature signal from said engine lubricating oil temperature sensor indicates an engine lubricating oil temperature of less than a second predetermined temperature value, then simultaneously:

(r1) controlling said first control valve, by said radiator flow regulation signal from said controller, so as to allow such a flow of cooling fluid through said radiator as to keep the temperature indicated by said sensed block output temperature signal from said block output fluid temperature snesor substantially at said first predetermined temperature value; and (r2) controlling said second control valve, by said block flow regulation signal, so as to allow a flow of cooling fluid from a downstream part of said radiator bypass conduit system and from said radiator and said radiator output conduit system to said cylinder block inlet of said block cooling jacket;

(q2) if said lubricating oil temperature signal from said engine lubricating oil temperature sensor indicates an engine lubricating oil temperature of greater than said second predetermined temperature value, then simultaneously:

(s1) controlling said first control valve, by said radiator flow regulation signal from said controller, so as to allow cooling fluid to flow through said radiator in substantially the maximum amount; and (s2) controlling said second control valve, by said block flow regulation system, so as to allow such a controlled amount of flow of cooling fluid from said radiator and said radiator output conduit system to said cylinder block inlet of said block cooling jacket, as to keep said temperature value indicated by said lubricating oil temperature signal from said engine lubricating oil temperature sensor at substantially a third predetermined temperature value which is substantially higher than said second temperature value.

* * * * *